US012312810B2

(12) United States Patent
Zhou et al.

(10) Patent No.: US 12,312,810 B2
(45) Date of Patent: May 27, 2025

(54) PREFABRICATED MULTI-CONDUIT BUILDING PANEL DESIGN

(71) Applicant: Wall to Wall, LLC, Hayward, CA (US)

(72) Inventors: Lisong Zhou, San Mateo, CA (US); Amit Haller, Belmont, CA (US); Eric Michael Dunn, Hayward, CA (US); John Robert Robillo Fidel, San Jose, CA (US)

(73) Assignee: Wall to Wall, LLC, Hayward, CA (US)

( * ) Notice: Subject to any disclaimer, the term of this patent is extended or adjusted under 35 U.S.C. 154(b) by 0 days.

(21) Appl. No.: 17/565,029

(22) Filed: Dec. 29, 2021

(65) Prior Publication Data

US 2022/0120081 A1 Apr. 21, 2022

Related U.S. Application Data

(63) Continuation-in-part of application No. 17/109,971, filed on Dec. 2, 2020.

(60) Provisional application No. 62/943,171, filed on Dec. 3, 2019, provisional application No. 63/005,708, filed on Apr. 6, 2020.

(51) Int. Cl.
*E04C 2/52* (2006.01)
*E04B 2/00* (2006.01)

(52) U.S. Cl.
CPC ..... *E04C 2/525* (2013.01); *E04C 2/46* (2013.01)

(58) Field of Classification Search
CPC .. E04C 2/46; E04C 2/52; E04C 2/525; H02G 3/281; H02G 3/288
USPC ..... 52/220.2
See application file for complete search history.

(56) References Cited

U.S. PATENT DOCUMENTS 2,653,357 A * 9/1953 Sanders ..... E03C 1/01 52/34
3,221,454 A 12/1965 Giulio
(Continued)

FOREIGN PATENT DOCUMENTS

DE 202008007139 U1 10/2009
WO WO 2008/004896 A2 1/2008

OTHER PUBLICATIONS

PCT International Search Report and Written Opinion, PCT Application No. PCT/US2022/054012, Jun. 6, 2023, 13 pages.
(Continued)

*Primary Examiner* — James J Buckle, Jr.
(74) *Attorney, Agent, or Firm* — Morrison & Foerster LLP

(57) ABSTRACT

Prefabricated wall panels simplify the constructive of building units and other structures. The prefabricated wall panels can include a set of conduits pre-installed within the wall panels that enable simplified installation and conduit routing within a building unit or structure. The set of conduits can include electrical conduit, plumbing conduit, HVAC conduit, networking conduit, fire alarm conduit, and fire sprinkler conduit. The prefabricated wall panels can include above-door cavities to assist with structure design and coupling conduits between prefabricated panels. The prefabricated panels can additionally include dual-headed fire sprinklers that enable one fire sprinkler conduit to spray into multiple rooms, reducing the overall number of fire sprinkler conduits required within a structure.

12 Claims, 20 Drawing Sheets

(56) References Cited

U.S. PATENT DOCUMENTS

| | | | | | |
|---|---|---|---|---|---|
| 3,694,973 | A * | 10/1972 | Unger | E04C 2/521 | 52/125.4 |
| 3,766,574 | A * | 10/1973 | Smid, Jr. | E04C 2/521 | 4/663 |
| 3,774,631 | A * | 11/1973 | Willkins | F16L 1/10 | 137/357 |
| 3,978,529 | A | 9/1976 | Krafft | | |
| 3,993,139 | A * | 11/1976 | Vaughn | A62C 35/60 | 169/62 |
| 4,151,882 | A * | 5/1979 | Baker | A62C 35/02 | 169/9 |
| 4,513,545 | A * | 4/1985 | Hopkins, Jr. | E04H 1/02 | 52/745.03 |
| 4,919,164 | A * | 4/1990 | Barenburg | E03C 1/01 | 137/15.08 |
| 5,076,310 | A | 12/1991 | Barenburg | | |
| 5,519,971 | A | 5/1996 | Ramirez | | |
| 5,675,194 | A | 10/1997 | Domigan | | |
| 5,724,773 | A | 3/1998 | Hall | | |
| 6,415,870 | B1 * | 7/2002 | Matsuoka | A62C 35/60 | 169/56 |
| 7,647,981 | B2 * | 1/2010 | Grant | A62C 35/64 | 239/209 |
| 8,172,588 | B2 | 5/2012 | Johnson | | |
| 8,172,589 | B2 | 5/2012 | Johnson | | |
| 8,215,065 | B2 * | 7/2012 | Gallant | E04B 2/74 | 52/64 |
| 8,978,324 | B2 * | 3/2015 | Collins | E04C 2/521 | 52/404.1 |
| 9,441,357 | B1 * | 9/2016 | Vafaee | E04B 1/34336 | |
| 9,455,561 | B2 | 9/2016 | Welch | | |
| 9,493,940 | B2 * | 11/2016 | Collins | E04B 1/34807 | |
| 9,526,933 | B2 * | 12/2016 | Kochelek | A62C 35/68 | |
| 9,610,466 | B2 * | 4/2017 | Burkhart | A62C 35/62 | |
| 9,790,684 | B2 * | 10/2017 | Neumayr | E04C 2/322 | |
| 9,972,985 | B1 * | 5/2018 | Tannenbaum | H02G 3/06 | |
| 10,077,553 | B2 | 9/2018 | Neumayr | | |
| 10,221,568 | B2 | 3/2019 | Ljubicic Rubio | | |
| 10,273,687 | B1 | 4/2019 | Walker | | |
| 10,538,905 | B2 | 1/2020 | Pirrung | | |
| 10,961,710 | B2 * | 3/2021 | Collins | E04C 2/521 | |
| 11,207,555 | B2 * | 12/2021 | Subbarao | A62C 35/68 | |
| 11,214,945 | B2 * | 1/2022 | Lundholm | E03C 1/02 | |
| 11,371,242 | B2 | 6/2022 | May | | |
| 11,572,691 | B1 * | 2/2023 | Newton | E04C 2/46 | |
| 11,585,091 | B2 * | 2/2023 | May | E04B 1/08 | |
| 11,680,403 | B2 * | 6/2023 | Perez | E04C 2/46 | 52/302.3 |
| 2005/0188632 | A1 | 9/2005 | Rosen | | |
| 2005/0210764 | A1 | 9/2005 | Foucher et al. | | |
| 2008/0175668 | A1 * | 7/2008 | Haese | E03B 1/04 | 405/36 |
| 2010/0065287 | A1 * | 3/2010 | Burkhart | A62C 35/68 | 169/17 |
| 2010/0229472 | A1 | 9/2010 | Malpas | | |
| 2014/0096980 | A1 * | 4/2014 | Dzegan | A62C 35/68 | 169/16 |
| 2014/0259994 | A1 * | 9/2014 | Lenberg | E03B 1/041 | 52/168 |
| 2015/0297926 | A1 * | 10/2015 | Dzegan | A62C 35/68 | 169/56 |
| 2017/0321415 | A1 * | 11/2017 | Vafaee | E04H 1/125 | |
| 2018/0038103 | A1 * | 2/2018 | Neumayr | E04C 2/46 | |
| 2021/0164227 | A1 | 6/2021 | Zhou et al. | | |
| 2022/0064935 | A1 * | 3/2022 | Williams | F24F 3/167 | |
| 2022/0120082 | A1 | 4/2022 | Zhou | | |
| 2022/0186496 | A1 | 6/2022 | Fidel | | |

OTHER PUBLICATIONS

PCT Invitation to Pay Additional Fees, PCT Application No. PCT/US2022/054012, Mar. 14, 2023, three pages.
United States Office Action, U.S. Appl. No. 17/109,971, filed Sep. 11, 2023, 9 pages.
United States Office Action, U.S. Appl. No. 17/565,048, filed Feb. 21, 2023, 8 pages.
United States Office Action, U.S. Appl. No. 17/565,033, filed Feb. 16, 2023, 10 pages.
United States Office Action, U.S. Appl. No. 17/109,971, filed Nov. 7, 2023, 10 pages.
United States Office Action, U.S. Appl. No. 17/565,033, filed Sep. 11, 2023, 9 pages.
Zhou et al., U.S. Office Action dated Dec. 20, 2023, directed to U.S. Appl. No. 17/565,033; 9 pages.
Zhou et al., U.S. Office Action mailed Feb. 16, 2023 directed to U.S. Appl. No. 17/109,971; 9 pages.
Zhou et al., U.S. Office Action mailed Sep. 4, 2024 directed to U.S. Appl. No. 17/109,971; 10 pages.
Zhou et al., U.S. Office Action mailed Sep. 5, 2024 directed to U.S. Appl. No. 17/565,033; 9 pages.

* cited by examiner

PREFABRICATED MULTI-CONDUIT BUILDING PANEL DESIGN

CROSS REFERENCE TO RELATED APPLICATIONS

This application is a continuation-in-part of U.S. application Ser. No. 17/109,971, filed Dec. 2, 2020, which claims priority to and the benefit of U.S. Provisional Application No. 62/943,171, filed on Dec. 3, 2019, and U.S. Provisional Application No. 63/005,708, filed on Apr. 6, 2020. The contents of each of these applications are incorporated by reference herein in their entirety.

BACKGROUND

This description generally relates to modular building units, and specifically to prefabricated, pre-wired, multi-conduit building panel design for modular building units.

On-site installation of electrical conduit, plumbing conduit, and other conduits of construction projects can often delay project completion, which can burden customers with increased costs and negatively impact contractors' reputations. Further, variations in installation practices among construction professionals can reduce quality uniformity across construction projects.

SUMMARY

A modular building unit is a panelized system that is composed of prefabricated panels designed for modular building of construction projects, including residential and commercial construction projects. A modular pre-wired building panel design facilitates the standardization of wiring, plumbing, and other conduit installation practices across construction projects. Panels (such as walls or ceilings) are prefabricated with a combination of electrical, network, plumbing, fire alarm, fire sprinkler, low voltage, HVAC, and other components pre-installed (e.g., installed within the panel before the transportation of the panel to a construction site). The panels are coupled during project assembly to form building structures. Prefabricated panels may be customized based on the size and configuration of the modular building unit, customer preferences, construction laws, circuit requirements of individual rooms, and the like.

In some embodiments, a modular building unit may include a combination of prefabricated wall panels, ceiling panels, floor panels, utility wall panels, and breaker panels. Modular building structures may include one or more primary wall panels (or "riser wall") that include a set of conduits pre-wired/pre-installed within the walls. The set of conduits can include any number of pre-installed conduits, which can be housed in any number of conduit housings. The conduits can be routed from the riser wall to one or more other wall panels or ceiling panels throughout a building structure. A first riser wall within a first floor of a building unit can be located below a second riser wall within a second floor of a building unit, enabling the set of pre-installed conduits within the first riser wall to couple to the set of pre-installed conduits within the second riser wall (e.g., via a conduit coupling in the first riser wall and a reciprocal conduit coupling in the second riser wall), providing conduit access to multiple floors within a structure.

Prefabricated wall panels can include cavities located within the wall panels above a door frame that provide space for the routing of a set of conduits within the wall panel. By reserving the space above the door, there is a guaranteed avenue that can be utilized to route the set of conduits from within the wall to another wall panel, or to allow conduit from a first wall panel to be route to a second wall panel via the above-door cavity within a third wall panel. Some modular building units can include rooms of varying heights within the same floor of the building unit. In such instances, the above-door cavity can be used to route a set of conduits from a ceiling of a first room abutting the wall panel including the above-door cavity into a ceiling of a second room abutting the wall panel via the above-door cavity.

Prefabricated wall panels can include fire sprinkler heads pre-installed within the wall panel. For interior wall panels that abut multiple rooms (e.g., a first room abutting a first surface of the interior wall panel and a second room abutting a second surface of the interior wall panel), the wall panels can include multi-headed fire sprinklers. Each wall panel can include a first pre-installed fire sprinkler conduit that carries water or another fire suppressant running vertically from a top surface or a bottom surface of the wall panel. The first conduit can be coupled to a second pre-installed conduit perpendicular to the first conduit and protruding from each of the first surface and the second surface of the wall panel. Each end of the second conduit can be coupled to a separate sprinkler head (e.g., a first sprinkler head within the first room and a second sprinkler head within the second room). Such a prefabricated wall panel can provide fire sprinkler access to multiple rooms, simplifying the design of a fire sprinkler system and improving the safety of the modular building unit.

The figures depict various example embodiments of the present technology for purposes of illustration only. One skilled in the art will readily recognize from the following description that other alternative embodiments of the structures and methods illustrated herein may be employed without departing from the principles of the technology described herein.

DETAILED DESCRIPTION

The concepts described herein are generally related to modular construction, a field of construction that, in general, relates to the prefabrication of construction materials at a location other than the construction location. For instance, wall panels, ceiling panels, conduit structures, foundation structures, support structures, frames, and the like can be prefabricated at (for example) a manufacturing location, and then transported to a construction location for assembly. By fabricating materials in advance, modular construction can enable the rapid assembly of prefabricated materials at the construction location, often reducing the total construction time significantly.

As used herein, a "modular building" refers to an outcome of a modular construction project, such as a dwelling structure, an office structure, an apartment complex, a skyrise building, or any other suitable residential, commercial, industrial, or other structure. A modular building may include a number of units, such as apartments, condominiums, offices, and the like. Each modular building can include particular sections, such as rooms, bathrooms, hallways, common areas, and the like. Each module building can include a number of prefabricated components or elements, such as prefabricated wall panels, prefabricated ceiling panels, and the like.

Figure 1:
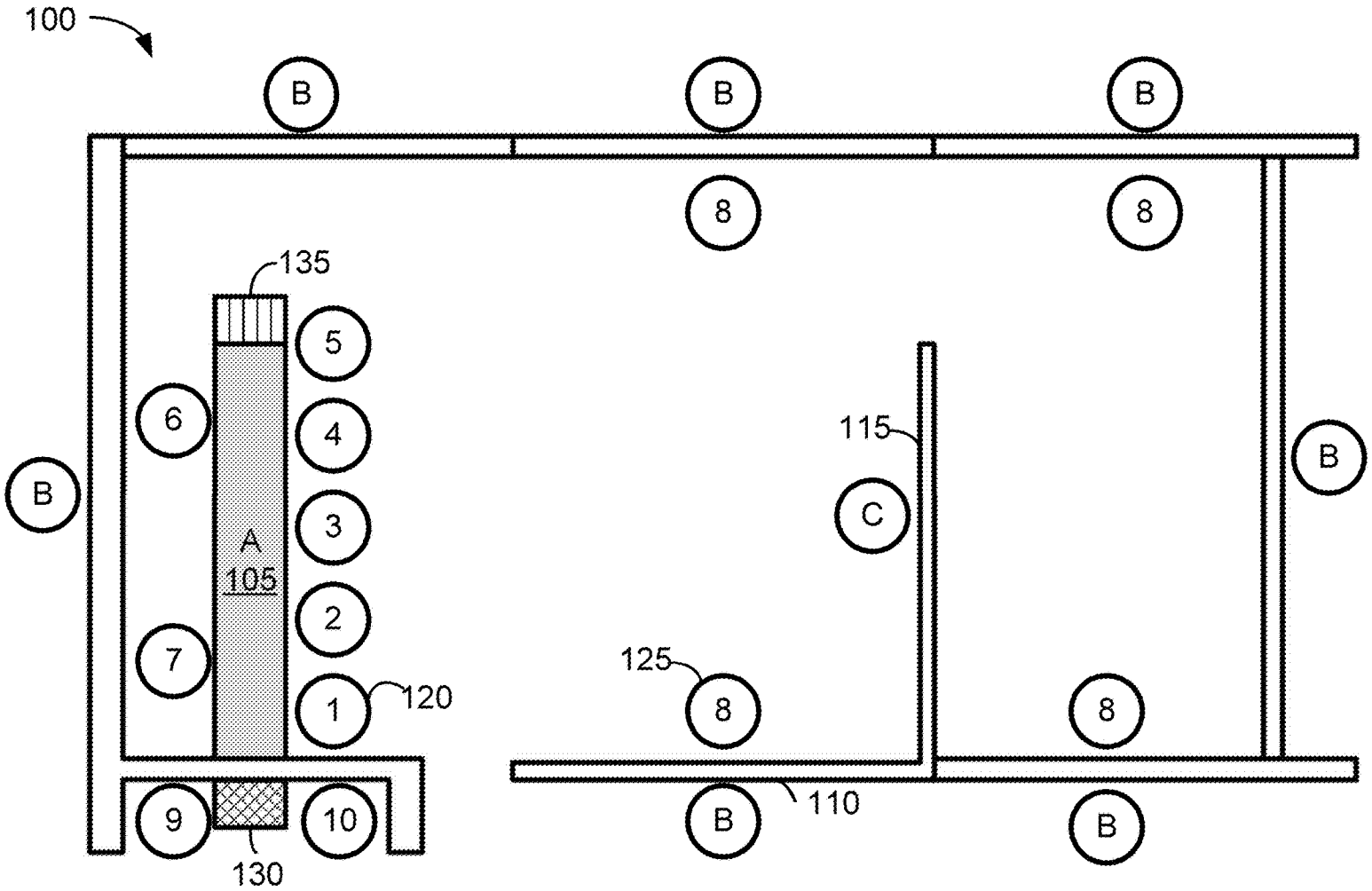
FIG. 1 illustrates a modular building unit, according to one embodiment.

FIG. 1 illustrates one embodiment of a modular building unit 100. A modular building unit is a panelized system that is composed of prefabricated panels designed to facilitate modular building of construction projects, including residential and commercial construction projects. Prefabricated panels include utility panels (labeled with an "A"), exterior wall panels (labeled with a "B"), interior wall panels (labeled with a "C"), floor panels, ceiling panels, and the like. Prefabricated panels are assembled or manufactured prior to use in assembling a structure, and may be assembled or manufactured at a different location than the location they are used to assemble a structure. The modular building unit 100 shown includes (among other panels) a utility wall panel 105, an exterior wall panel 110, and an interior wall panel 115. Each panel of the modular building unit 100 is prefabricated to include a combination of electrical and plumbing components so that modular building units of varying sizes and configurations can be efficiently assembled based on customer preferences, construction laws in various jurisdictions, and the room-specific circuit requirements (e.g., current, voltage, wiring location requirements, etc.).

Prefabricated panel components may include a combination of power outlets (e.g., GFCI and AFCI outlets), network outlets (e.g., network ports, controls), plumbing pipes (e.g., cold water, hot water, sewage pipes), and other conduits as described herein. Power outlets may be used for various appliances and electronics of the modular building unit, such as cooktops, dishwashers, garbage disposals, refrigerators, microwaves, range hoods, kitchen and bathroom receptacles, washing machines, dryers, bedroom receptacles, living room receptacles, air conditioners, water heaters, and the like. The modular building unit 100 shown includes several power outlets embedded within a utility wall panel 105, including power outlet 120, a prefabricated exterior wall panel 110 with one power outlet 125, and an interior wall panel 115 without power outlets. However, the location and configuration of components within alternative modular building units may vary.

Prefabricated panels may also include electrical junctions that are connected to the power outlets and/or network outlets via electrical conduits or network lines. The location and number of electrical junctions within each prefabricated panel may vary. For example, electrical junctions may be located at the top or the bottom of the prefabricated wall panels, an electrical junction may be coupled to one or more outlets, prefabricated panels may include multiple electrical junctions, and the like. An electrical junction includes a coupling interface that enables electrical and/or communicative coupling of the corresponding prefabricated panel to a reciprocal electrical junction of an adjacent prefabricated panel of the modular building unit 100. In some embodiments, the electrical junctions are embedded within the prefabricated panels with coupling interfaces at locations on the surface of the prefabricated panels (for instance, along a surface of the prefabricated panels that abuts a surface of another prefabricated panel) such that when a coupling interface of a first prefabricated panel couples to a coupling interface of a second prefabricated panel, neither the coupling interfaces nor the electrical junctions are visible from within the structure. Plumbing pipes may also include coupling interfaces such that the plumping pipes are configured to couple to plumbing pipes in adjacent prefabricated wall panels, water systems, mechanical, electrical, plumbing (MEP) rooms, and the like, during assembly of the modular building unit.

The modular building unit 100 further includes one or more breaker panels. Breaker panels (when coupled to an exterior power source) may provide power outlets electricity through feeder lines of the breaker panel. In some embodiments, electricity flows through the feeder lines directly to the power outlets embedded within a prefabricated wall panel. For example, electricity may flow to the power outlets along utility wall panel 105 directly from a feeder line. In alternative embodiments, electricity flows from the feeder lines through one or more electrical junctions coupled to the power outlets.

The breaker panel may be located on an exterior wall of the modular building unit 100, such as the first breaker panel 130. Alternatively, the breaker panel may be located on an interior wall of the modular building unit 100, such as the second breaker panel 135. In some embodiments, the modular building unit 100 includes more than one breaker panel.

Figure 2:
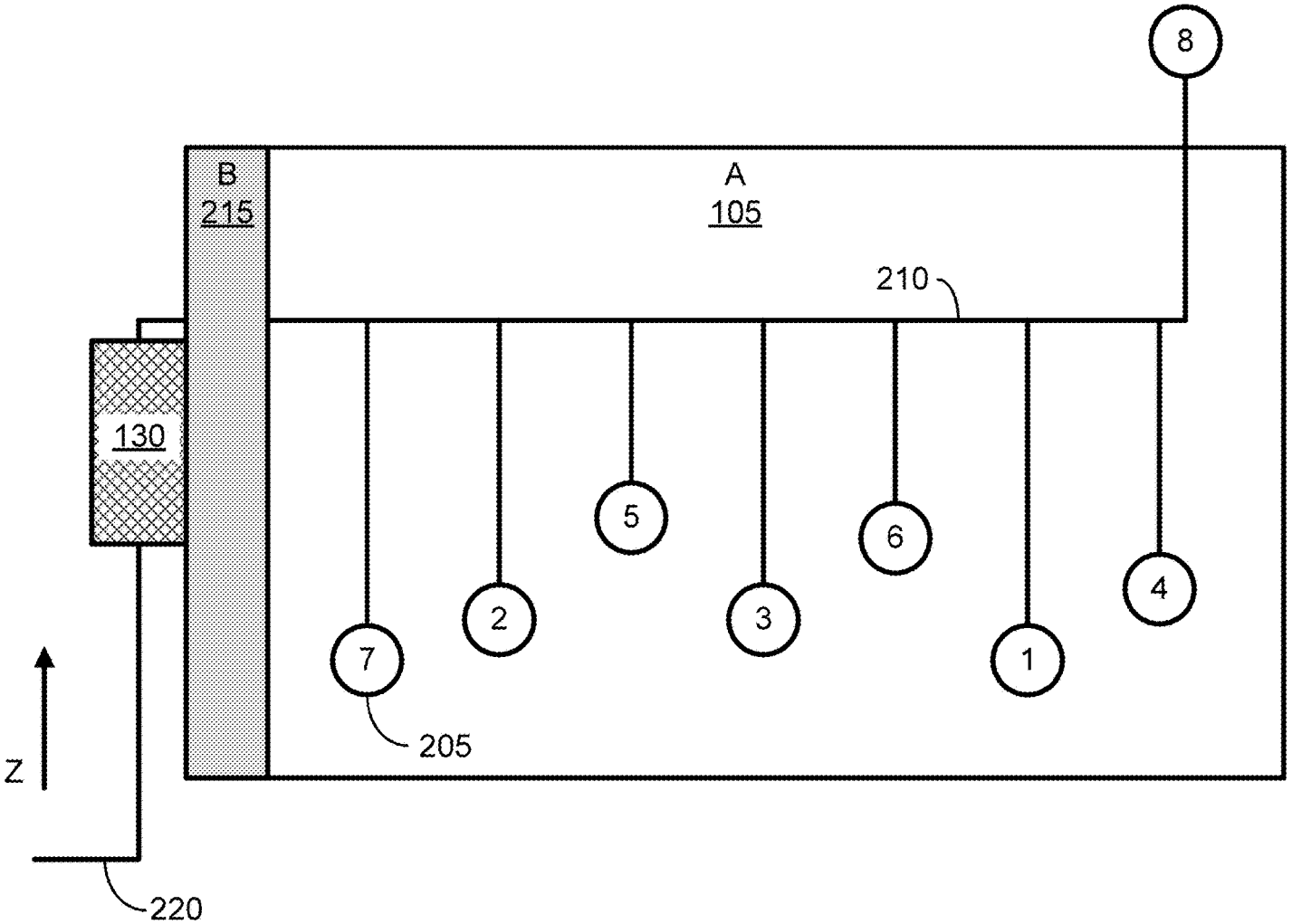
FIG. 2 illustrates a prefabricated utility wall panel, according to one embodiment.

FIG. 2 illustrates one embodiment of a prefabricated utility wall panel 105. The utility wall, when installed within the building unit, extends from a floor of the building unit towards a ceiling of the building unit, and may extend all the way to the ceiling of the building unit. The power outlets, such as power outlet 7 205, and the feeder line 210 are embedded within the utility wall panel 105 during prefabrication. Similarly, the breaker panel 130 is embedded within the exterior wall panel 215 during prefabrication. As shown, the power outlets are electrically coupled to the feeder line 210, which is configured to be electrically coupled to the breaker panel 130 upon assembly of the modular building unit 100. The breaker panel 130 may include an underground feeder line 220. Alternatively, the breaker panel 130 may include an overhead feeder line, extending upwards from the utility wall towards a feeder line embedded within a ceiling panel of the building unit.

Figure 3A:
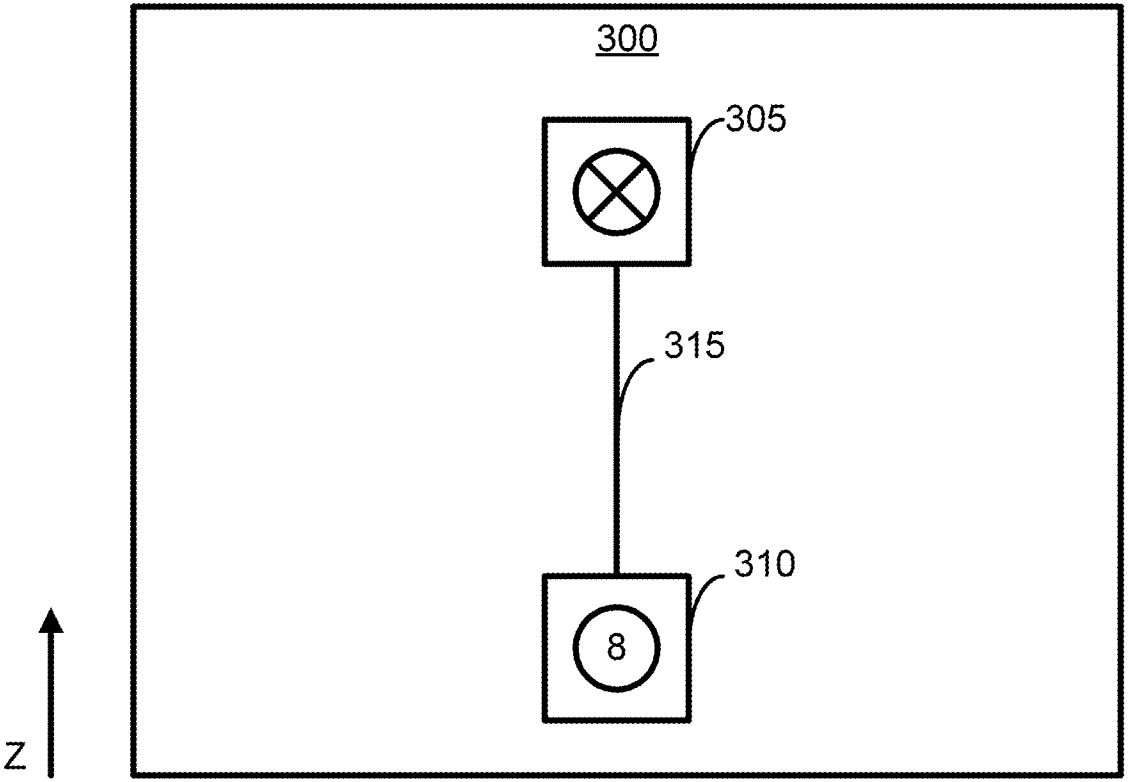
FIG. 3A illustrates a prefabricated wall panel, according to one embodiment.

FIG. 3A illustrates one embodiment of a prefabricated wall panel 300. The illustration shows the pre-wiring of a prefabricated wall panel. The prefabricated wall panel 300 includes an electrical junction 305 electrically coupled to a power outlet 310 through an electrical conduit 315. In some embodiments, holes may be cut into the frame of the prefabricated wall panel 300 for the interconnection of the electrical junction 305 and the power outlet 310. In some embodiments, the electrical junction includes a junction box (e.g., a J-box) and a connector (e.g., a z-wave relay). The power outlet 310 may include GFCI outlets, AFCI outlets, and the like. The electrical conduit may be wiring cable suitable for the amperage rating of the corresponding circuit, such as AWG 14 wiring. The electrical junction 305 may be mounted to the prefabricated wall panel 300 to meet construction requirements. For example, the electrical junction 305 may be mounted to a stud of the prefabricated wall panel 300, and the electrical conduit 315 may be secured to and run along the stud.

While the prefabricated wall panel 300 shown includes one electrical junction 305 coupled to a single power outlet 310, electrical junctions may be coupled to more than one power outlet. Further, prefabricated wall panels may include additional electrical junctions. Additional electrical junctions may be included based on the circuit requirements of the rooms enclosed by and on each side of the wall panel. For example, a first side of a prefabricated wall panel may be a wall of a bathroom with different and distinct circuit requirements than a kitchen on an opposite side of the wall. Prefabricated wall panels may also include additional electrical junctions coupled to network outlets through network lines, discussed in detail with reference to FIGS. 7-8.

Figure 3B:
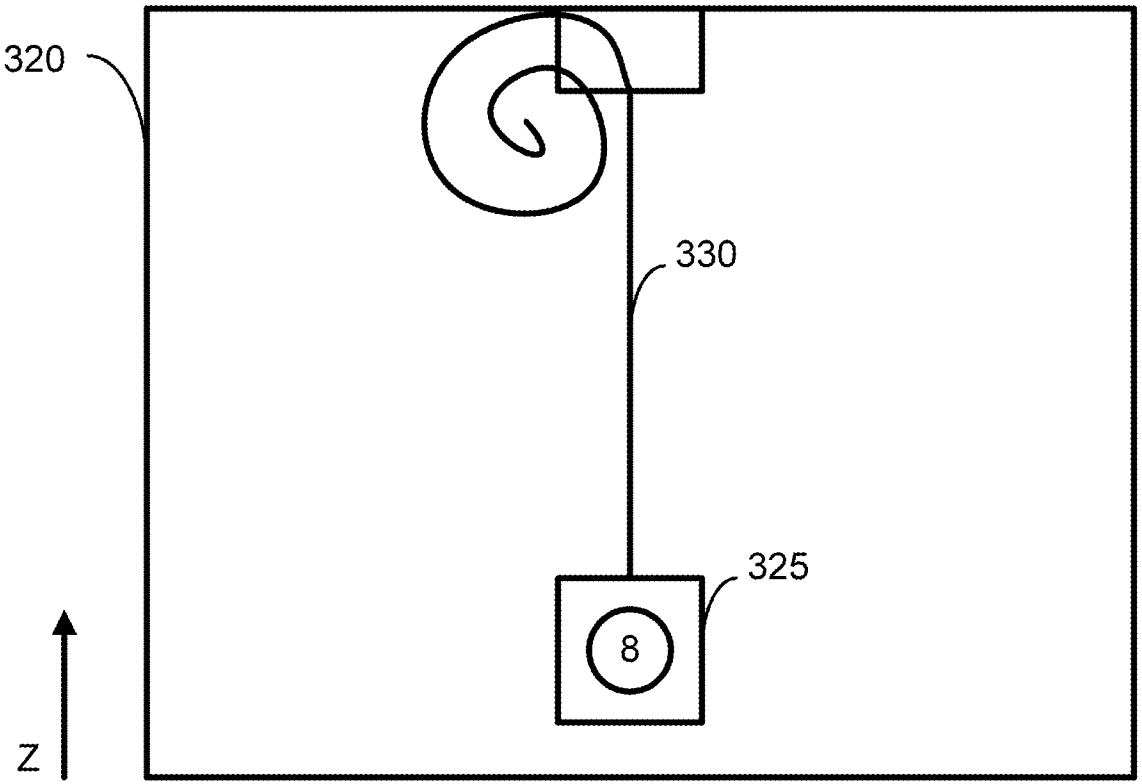
FIG. 3B illustrates an additional prefabricated wall panel, according to one embodiment.

FIG. 3B illustrates an embodiment of an additional prefabricated wall panel 320. The prefabricated wall panel 320 includes a power outlet 325 coupled to a wiring cable 330. The wiring cable 330 may be measured and cut to an appropriate length during assembly of the modular building unit. The wiring cable 330 may be fed through precut holes of the prefabricated panels during assembly to electrically couple the prefabricated wall panel 320 to an adjacent prefabricated wall panel. In some embodiments, coupling the prefabricated wall panel 320 of FIG. 3B requires on-site effort not otherwise required by the prefabricated wall panel 300 of FIG. 3A.

Figure 4:
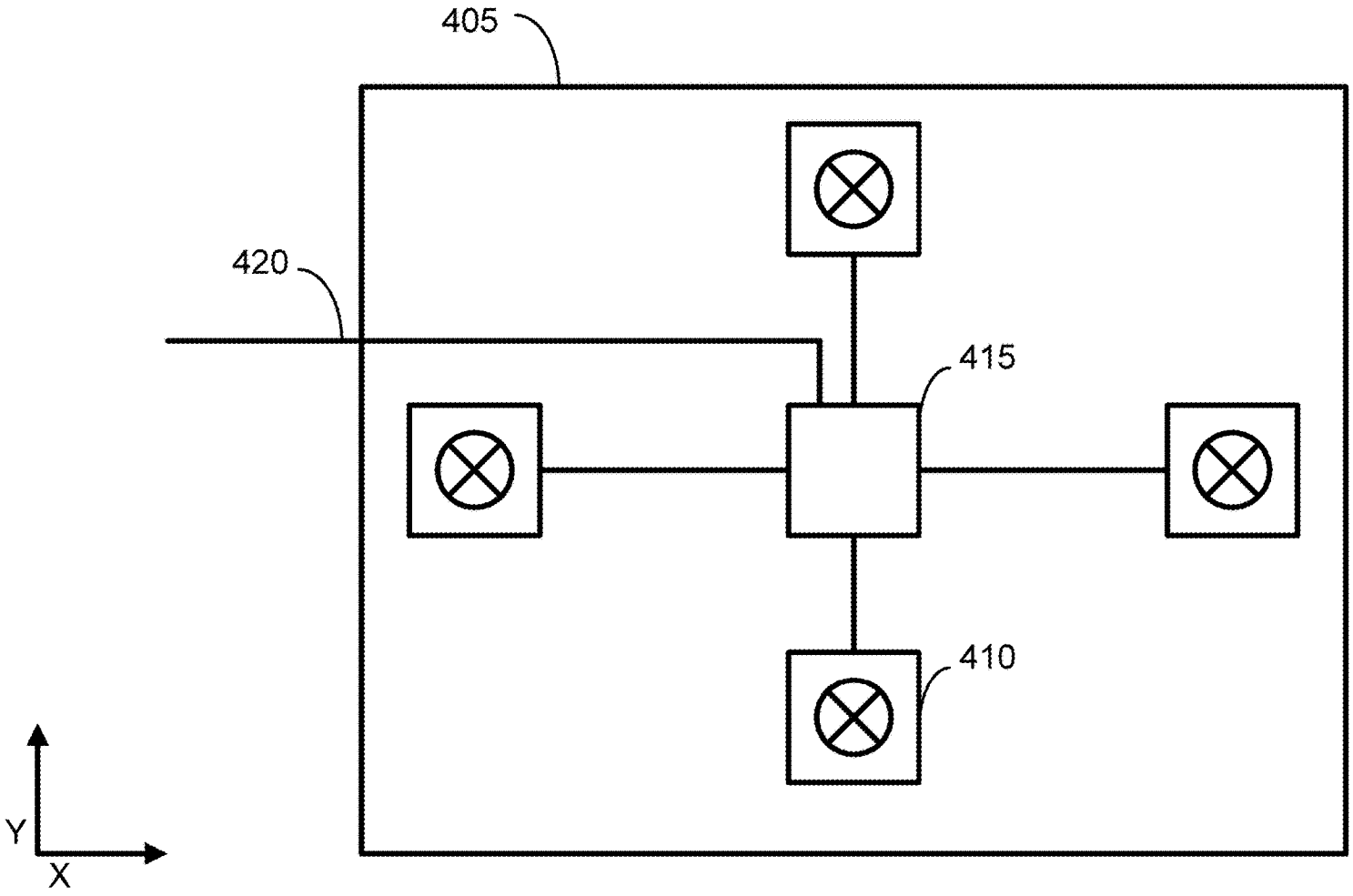
FIG. 4 illustrates a prefabricated ceiling panel, according to one embodiment.

FIG. 4 illustrates one embodiment of a prefabricated ceiling panel 405. The prefabricated ceiling panel 405 includes exterior electrical junctions, such as exterior electrical junction 410. The exterior electrical junction 410 includes a coupling interface (not shown) such that the exterior electrical junction 410 can be electrically coupled to an electrical junction of an adjacent wall panel, such as an exterior wall panel or an interior wall panel, during assembly of the modular building unit.

During prefabrication, the exterior electrical junctions are electrically coupled to the central electrical junction 415 of the prefabricated ceiling panel 405. The central electrical junction 415 enables the flow of electricity from a breaker panel to the power outlets embedded within the prefabricated wall panels of the modular building unit through the central electrical junction 415 and the exterior electrical junctions. In one embodiment, electricity flows from the breaker panel to the central electrical junction 415 via a loose connector wire 420 configured to be coupled to the breaker panel during assembly. The central electrical junction 415 may then distribute electricity to the exterior junctions of the ceiling panel 405. The exterior junctions of the ceiling panel facilitate the flow of electricity to the power outlets of a prefabricated wall panel through the electrical junctions of the prefabricated wall panel and the electrical conduits connecting them. The central electrical junction 415 can electrically couple to a central electrical junction of an adjacent ceiling panel, enabling a daisy-chain of consecutive adjacent ceiling panels from the breaker panel and through each ceiling panel. In alternative embodiments, exterior and central electrical junctions may be located within prefabricated floor panels of a modular building unit. In these embodiments, electricity flows from the breaker panel, through the prefabricated floor panels to the power outlets of the prefabricated wall panels.

Figure 5:
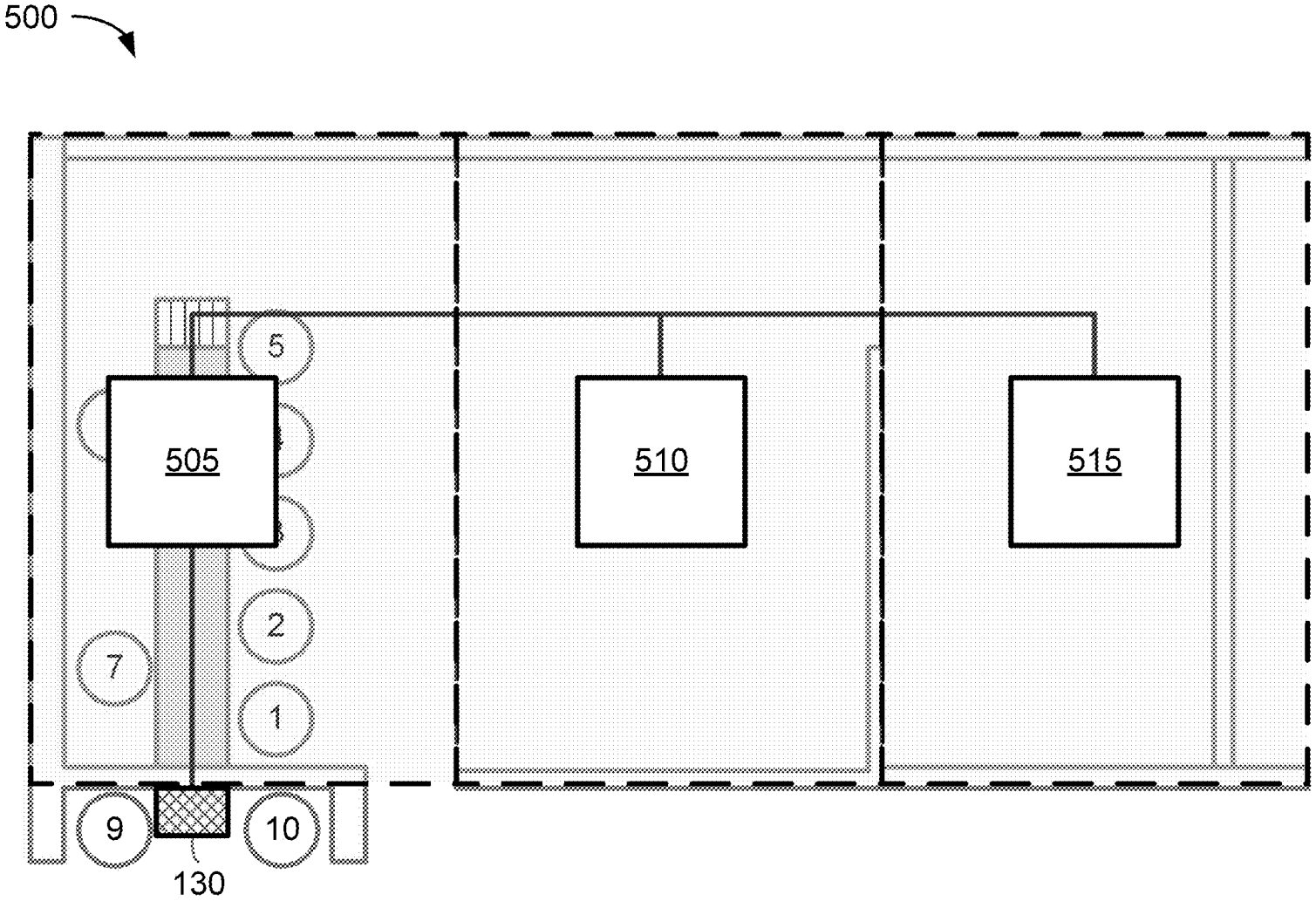
FIG. 5 illustrates a coupling of prefabricated ceiling panels of a modular building unit, according to one embodiment.

FIG. 5 illustrates one embodiment of the coupling of prefabricated ceiling panels of a modular building unit 500 post-ceiling installation. As discussed above with reference to FIG. 4, the central electrical junction of a ceiling panel is electrically coupled to one or more exterior junctions of the ceiling panel. During installation of the ceiling, the central electrical junctions of the prefabricated ceiling panels are electrically coupled to each other and to the breaker panel of the modular building unit 500. Through these couplings, electricity can flow from the breaker panel 130 to the power outlets of the modular building unit 500.

The modular building unit 500 shown includes a first ceiling panel with a first central electrical junction 505. The first central electrical junction 505 is electrically coupled to the breaker panel 130. In some embodiments, a second electrical junction 510 of a second ceiling panel and a third electrical junction 515 of a third ceiling panel are serially coupled to the first central electrical junction 505. In other embodiments, the central electrical junctions may be connected in parallel, or connected in any other suitable configuration.

In some embodiments, the central electrical junction of the ceiling panel adjacent to the utility wall of the modular building unit is electrically coupled to an electrical junction of the utility wall. In other embodiments, as discussed with reference to FIG. 2, the power outlets of a utility wall are directly wired to a feeder line of the breaker panel 130.

Figure 6:
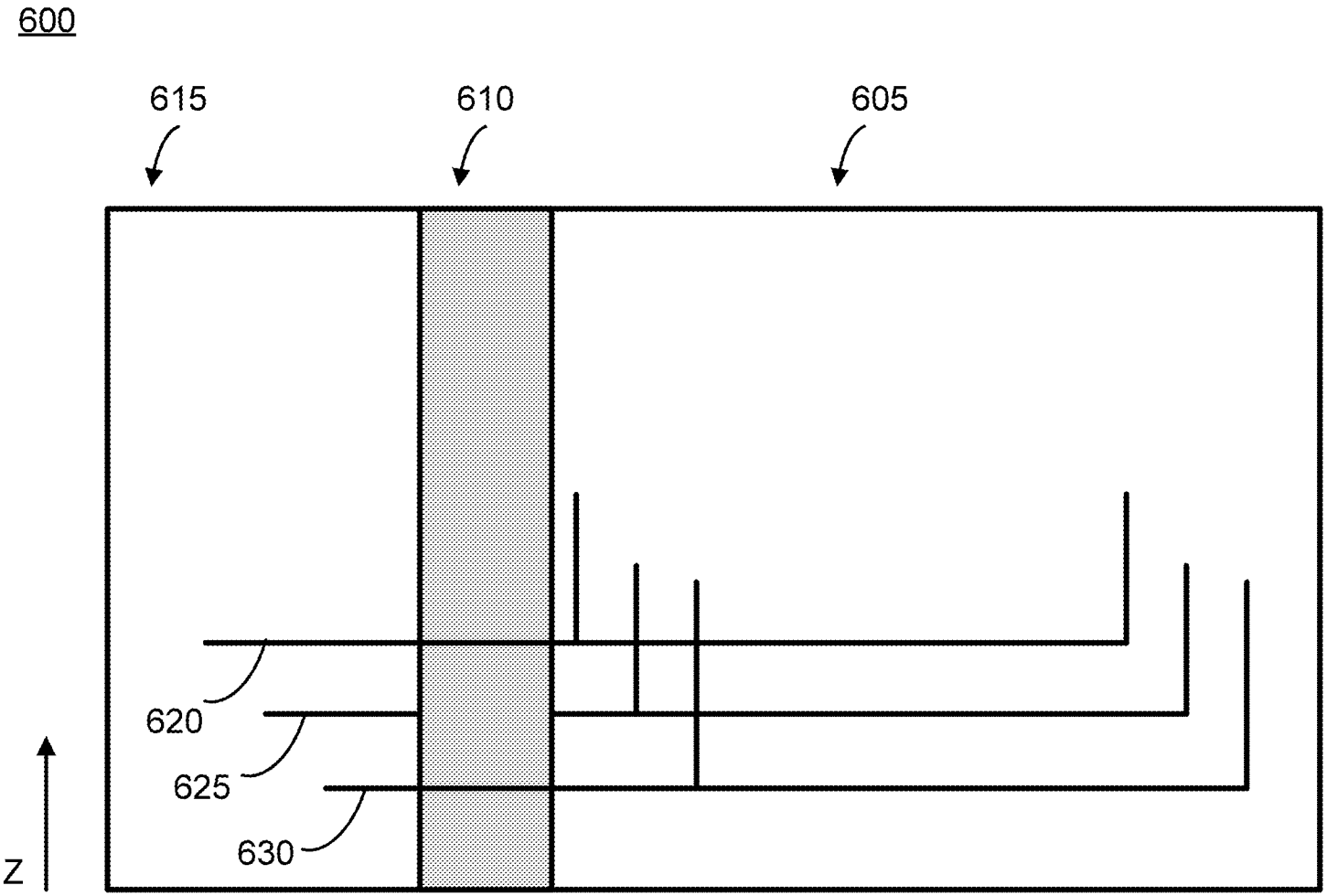
FIG. 6 illustrates plumbing pipes embedded within a prefabricated wall panel, according to one embodiment.

FIG. 6 illustrates one embodiment of plumbing pipes embedded within a prefabricated wall panel. Plumbing pipes are added to prefabricated wall panels during prefabrication. Plumbing pipes may have a coupling interface configured to couple to one or more water systems of the modular building unit. For example, the illustration 600 shows plumbing pipes extending from within a prefabricated wall panel 605, through an exterior wall panel 610 into a mechanical, electrical, plumbing (MEP) room 615 of the modular building unit. Plumbing pipes may also have additional coupling interfaces such that they are configured to couple with plumbing pipes in adjacent prefabricated panels, including prefabricated wall panels and prefabricated floor panels. Examples of plumbing pipes may include a cold water plumbing pipe 620, a hot water plumbing pipe 625, and a sewage plumbing pipe 630.

Figure 7:
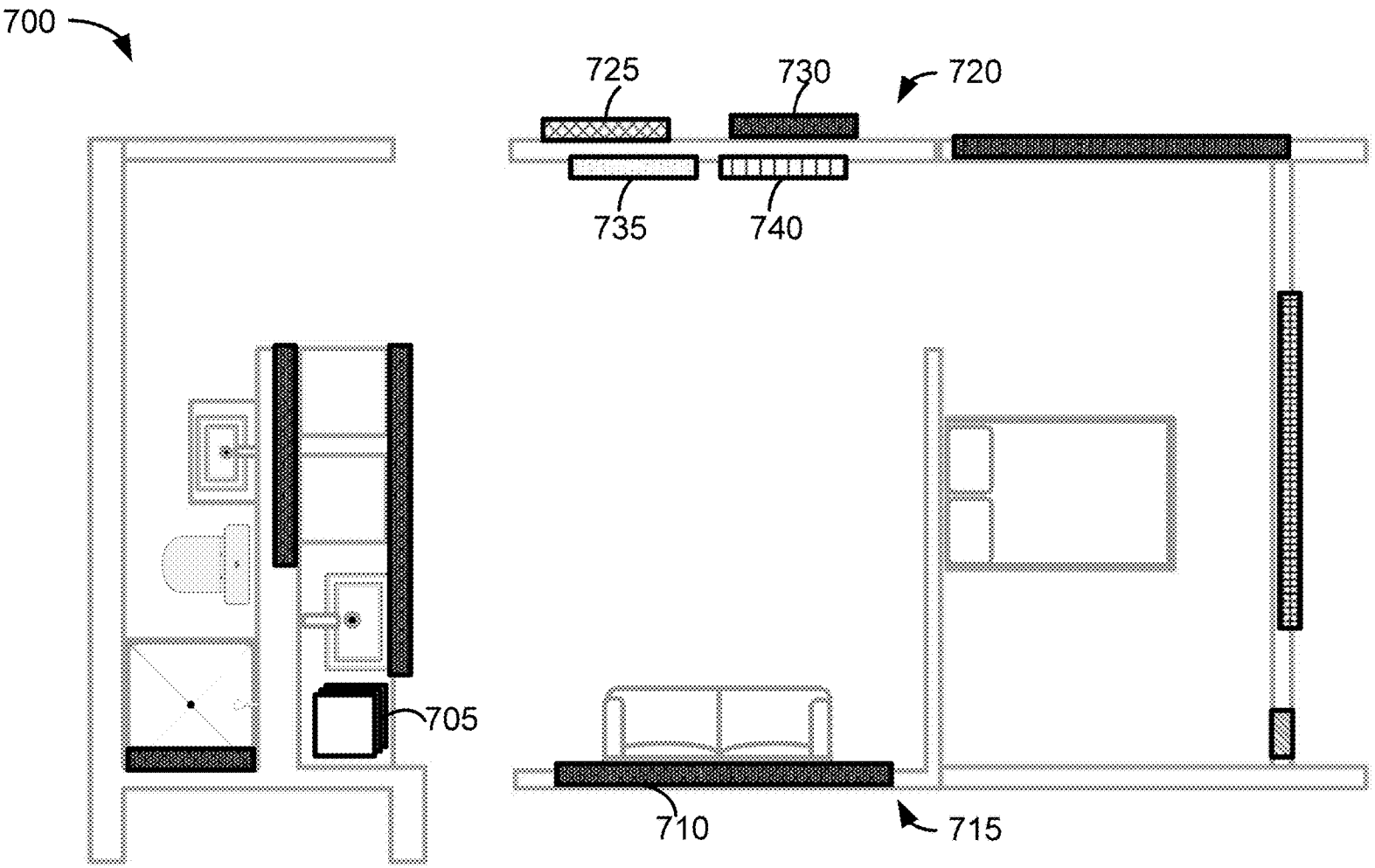
FIG. 7 illustrates a modular building unit with network outlets, according to one embodiment.

FIG. 7 illustrates one embodiment of a modular building unit 700 with network outlets. Network outlets may be embedded within the panels of the modular building unit 700 and coupled to network lines during prefabrication. Examples of network outlets include UPSs, POE switches, NUCs, VPN sticks, Z-wave sticks, modem outlets, router outlets, P/S 24V DCs, ethernet-2-DMX, DMX decoder, patch panels, USB outlets, cat or ethernet outlets, and the like. Network outlets may be used for light fixtures, fans (e.g., exhaust fans), sensors, blinds (e.g., roller blinds), televisions, door bells, energy monitors, flow meters, etc. Network lines are configured to enable the flow of data to the network outlets from a central network hub, such as a smart home hub, and are configured to enable the flow of electricity through the network lines, for instance at a voltage lower than the voltage of the electricity that flows through the electrical conduit described above. As with the electrical outlets discussed above, network lines are coupled to additional electrical junctions of the prefabricated panels. The additional electrical junctions include connectors chosen based on the protocols of the corresponding network outlets. Examples of protocols include POE, DMX, Z-wave, RF, WIFI, and the like. The additional electrical junctions may also include coupling interfaces that enable adjacent prefabricated panels to communicatively couple during assembly of the modular building unit 700.

In some embodiments, the network outlets are communicatively coupled to a smart home hub that allows users to control settings of the network connectors via one or more control panels and/or through a user device, such as a smart phone, tablet, or computer. For example, control panels may allow users to adjust the temperature of the modular building unit, raise blinds, shut off lights, and the like. The number of control panels may vary based on the size and configuration of the modular building unit. For example, a modular building unit with three rooms may include three control panels.

The modular building unit 700 shown includes a smart home hub 705 that is communicatively coupled to the network outlets. The arrangement of network outlets may vary based on the configuration of the modular building unit, user preferences and habits, and the like. Network outlets may be located on prefabricated exterior wall panels, interior wall panels, ceiling panels, floor panels, etc. Similarly, network outlets may be located on either side of a prefabricated panel. For example, the lighting fixture 710 of the prefabricated exterior wall panel 715 is located on the interior side of the prefabricated panel 715. The prefabricated exterior wall panel 720 includes network connectors on both the interior and exterior sides of the prefabricated panel 720. As shown, the prefabricated exterior wall panel 720 includes a doorbell 725 and light fixture 730 on the exterior side and a control panel 735 and ethernet port 740 on the interior side.

Figure 8:
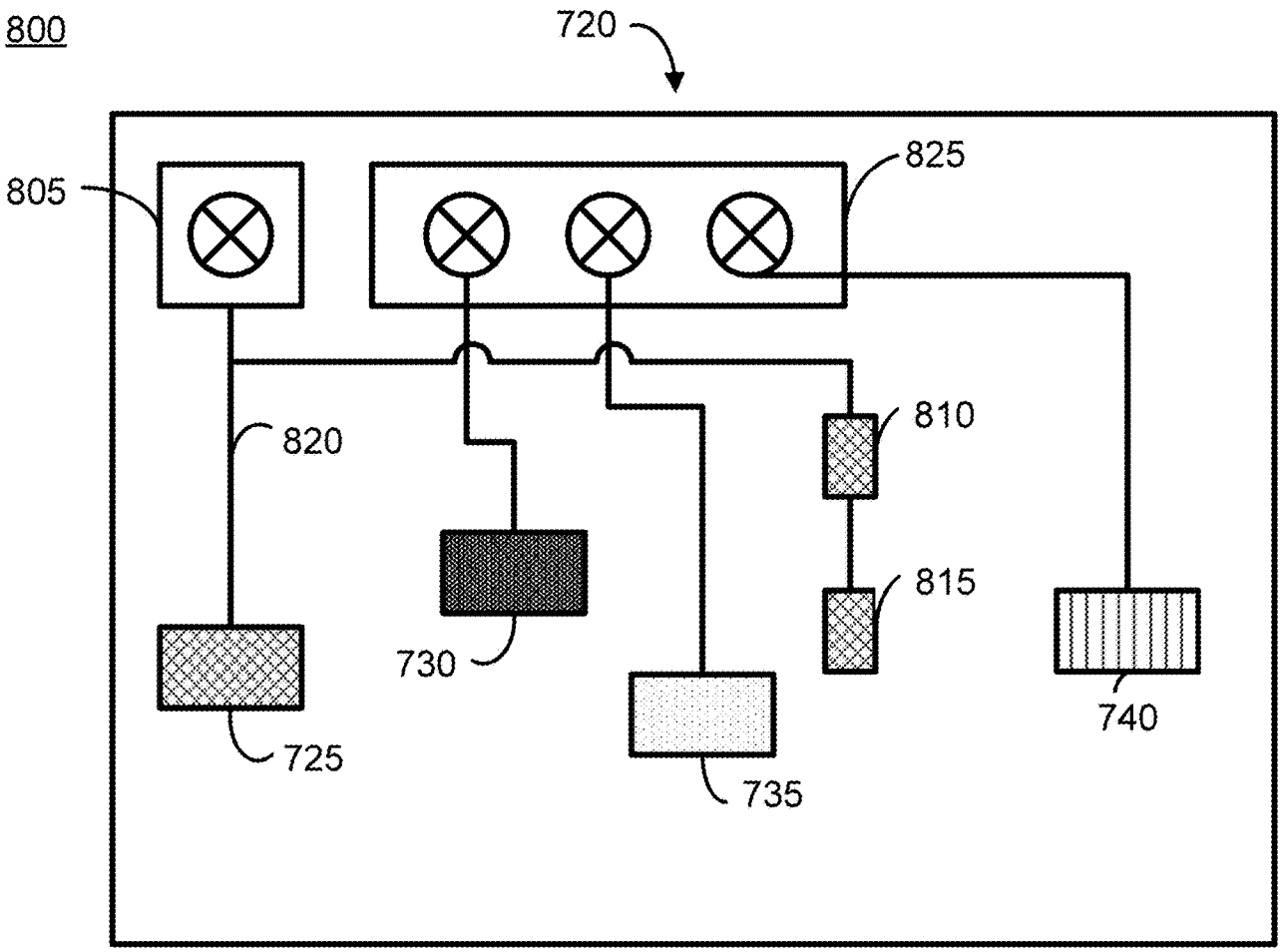
FIG. 8 illustrates the coupling of a prefabricated wall panel with electrical conduits and network lines, according to one embodiment.

FIG. 8 illustrates one embodiment of the coupling of a prefabricated wall panel 720 with electrical conduits and network lines. As discussed above, prefabricated panels may include both power outlets and network outlets. Power outlets and network outlets are prefabricated into wall panels such that they can couple to adjacent panels during assembly of the modular building unit. In some embodiments, prefabricated panels have electrical junctions wired to the power outlets and additional electrical junctions wired to the network outlets. The electrical junction coupled to the network outlets enable the flow of data from a network hub, such as a smart home hub, to the network outlets. Electrical junctions may include a junction box with one or more connectors and a coupling interface such that the corresponding prefabricated panel of a coupling interface can couple with a reciprocal coupling interface of an electrical junction of an adjacent prefabricated panel.

The illustration 800 shows two electrical junctions. The first electrical junction 805 is electrically coupled to the doorbell 725 and to two power outlets, power outlet 810 and power outlet 815 through electrical conduits, e.g., electrical conduit 820. The first electrical junction 805 may provide a standard power voltage (e.g., 110V AC) to the power outlets it is coupled with. The second electrical junction 825 includes a group of connectors that are each connected to a network outlet through a network line. As shown, the second electrical junction 825 includes connectors coupled to a light fixture 730, control panel 735, and an ethernet port 740. The second electrical junction 825 enables data to flow from the network lines to each of the network outlets. The second electrical junction 825 may also enable the flow of electricity (e.g., low voltage electricity) to each of the network outlets. As shown, the second electrical junction 825 includes a dedicated connector for each network outlet. However, in alternative embodiments, a connector of the electrical junction may be coupled to more than one network outlet.

Figure 9:
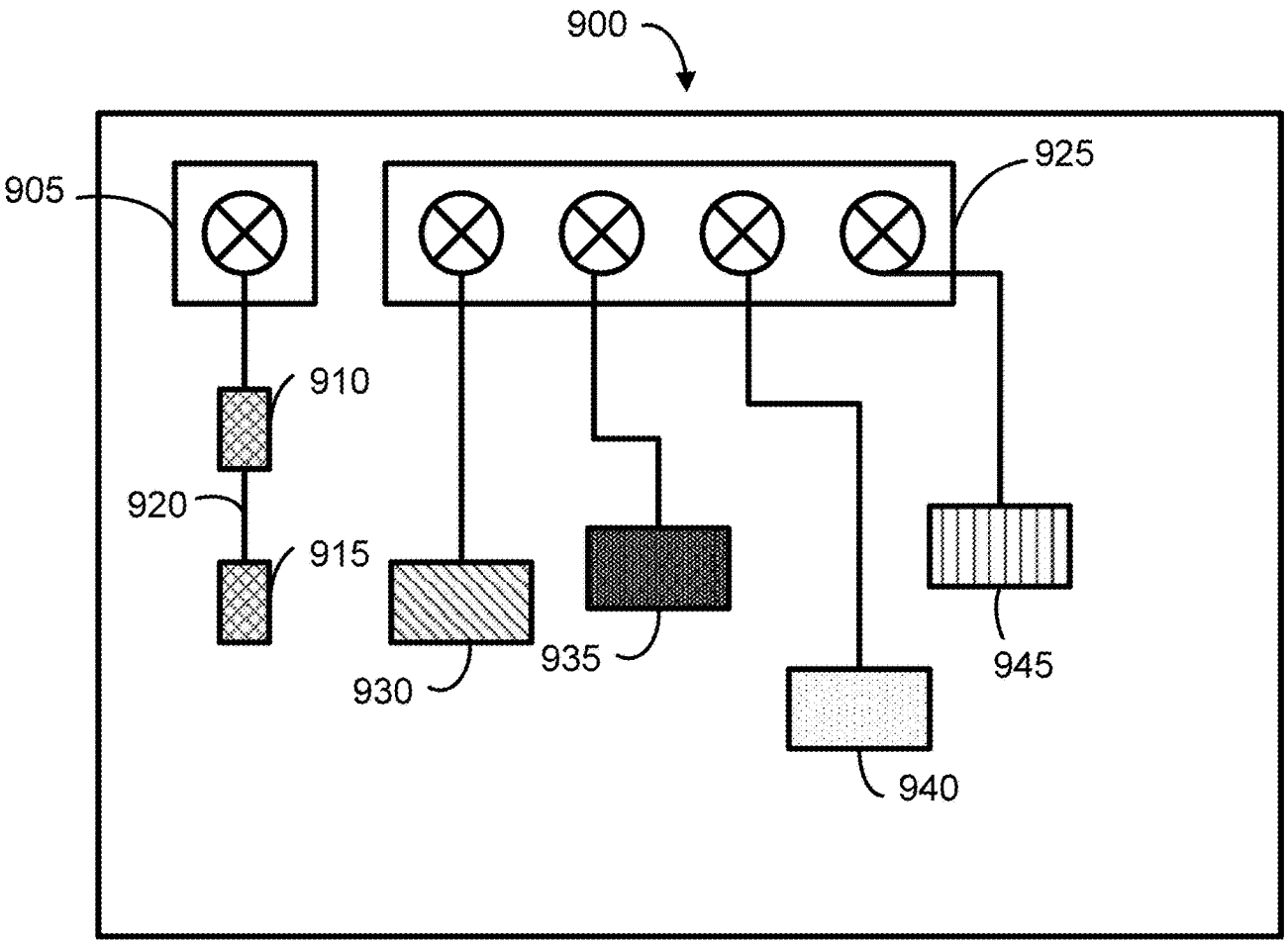
FIG. 9 illustrates an example of a prefabricated wall panel, according to one embodiment.

FIG. 9 illustrates an example embodiment of a prefabricated wall panel 900. Prefabricated panels may include both power outlets and network outlets. Power outlets and network outlets are prefabricated into wall panels such that they can couple to adjacent panels during assembly of a modular building unit. In some embodiments, prefabricated panels have electrical junctions wired to the power outlets and additional electrical junctions wired to the network outlets, as shown in FIG. 9.

The wall panel 900 illustrated in FIG. 9 includes two electrical junctions. The first electrical junction 905 is electrically coupled to two power outlets, power outlet 910 and power outlet 915 through electrical conduits, e.g., electrical conduit 920. The first electrical junction 905 may provide a standard power voltage (e.g., 110V AC) to the power outlets it is coupled with. The second electrical junction 925 includes a group of connectors that are each connected to a network outlet through a network line. As shown, the second electrical junction 925 includes connectors coupled to a doorbell 930, a light fixture 935, a control panel 940, and an ethernet port 945. The second electrical junction 925 enables data to flow from the network lines to each of the network outlets. The second electrical junction 925 may also enable the flow of electricity (e.g., low voltage electricity) to each of the network outlets. As shown, the second electrical junction 925 includes a dedicated connector for each network outlet. However, in alternative embodiments, a connector of the electrical junction may be coupled to more than one network outlet, as discussed with reference to FIG. 10.

Figure 10:
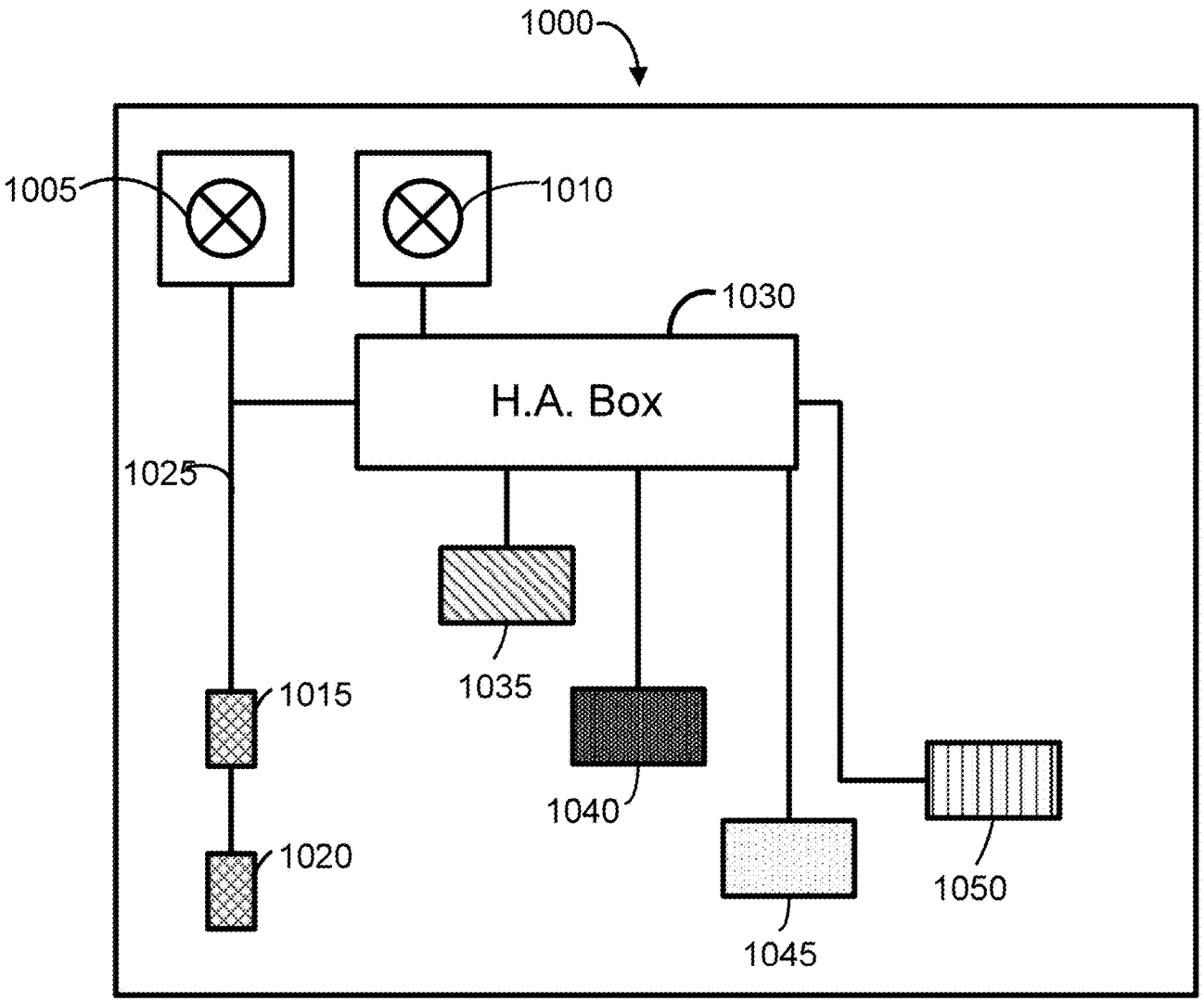
FIG. 10 illustrates an additional example of a prefabricated wall panel, according to one embodiment.

FIG. 10 illustrates an additional example embodiment of a prefabricated wall panel. The prefabricated wall panel 1000 shown includes two electrical junctions, and each junction includes one electrical connector, e.g., the first electrical connector 1005 and the second electrical connector 1010. The electrical connector 1005 may provide a standard power voltage to the power outlets it is coupled with. As shown, the electrical connector 1005 is electrically coupled to two power outlets, power outlet 1015 and power outlet 1020 through electrical conduits, e.g., electrical conduit 1025. The second electrical connector 1010 enables the flow of data within the prefabricated wall panel 1000. Both the first electrical connector 1005 and the second electrical connector 1010 are connected to a home automation box 1025. The home automation box 1030 receives power from the first electrical junction 1005 and data from the second electrical junction 1010. The home automation box 1030 utilizes the data to control the utilities within the prefabricated wall panel 1020, e.g., a doorbell 1035, light fixture 1040, control panel 1045, and ethernet port 1050.

Figure 11:
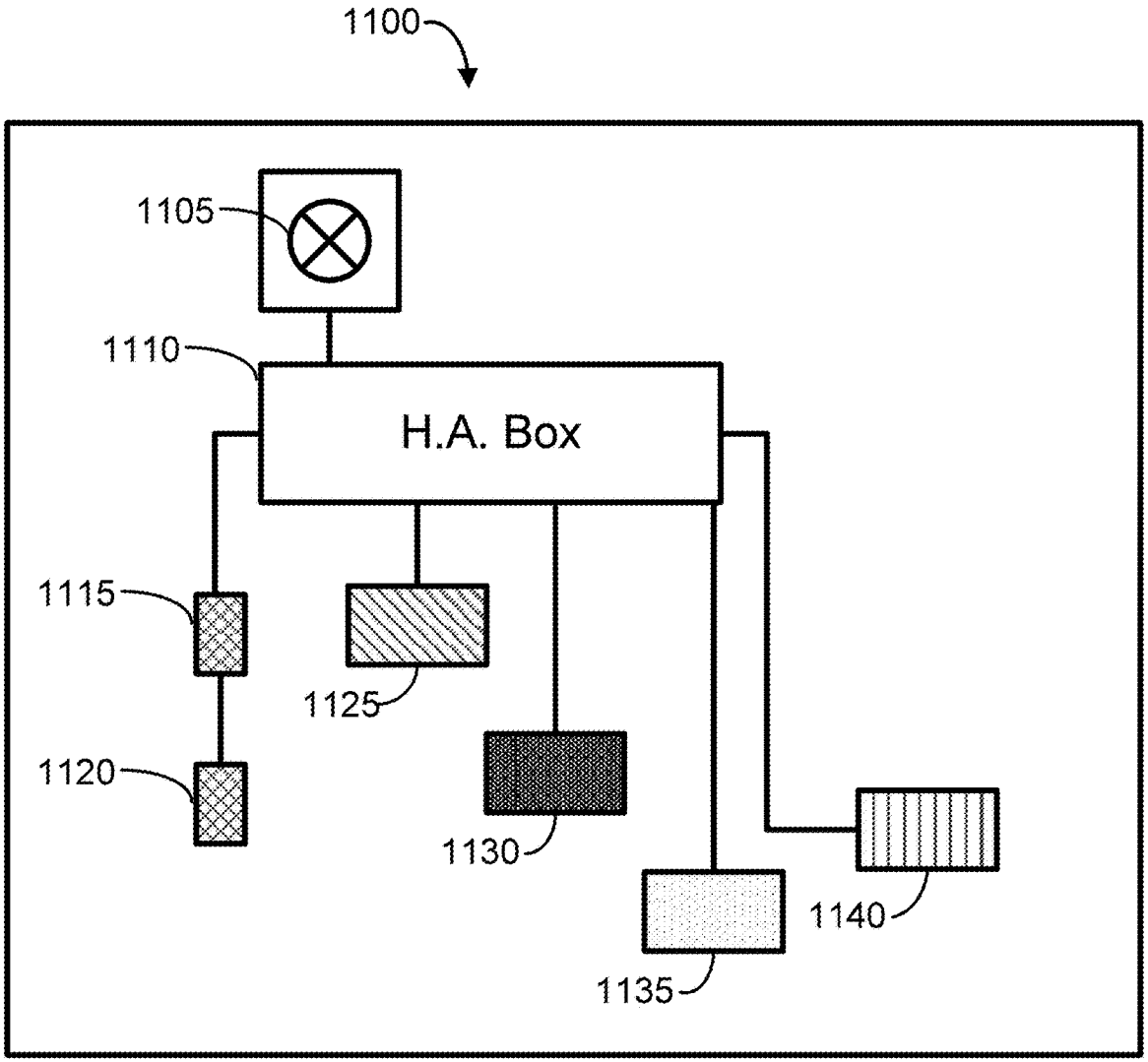
FIG. 11 illustrates an additional example a prefabricated wall panel, according to one embodiment.

FIG. 11 illustrates an additional example embodiment a prefabricated wall panel 1100. In the embodiment shown, the single connector 1105 of the prefabricated wall panel 1100 provides both power and data to the prefabricated wall panel over a single conduit (or a plurality of conduits combined into a single connector) using a power line communication (PLC) protocol. Using the PLC protocol, data signals can be encoded within the power signals, beneficially enabling a controller, such as the home automation box 1110 to decode the data signals received from the connector 1105 from the power signals.

The home automation box 1110, after decoding the data signals, can use the data signals to control the utilities within the prefabricated wall panel 1100. The utilities in the prefabricated wall panel 1100 shown include two power outlets, namely power outlet 1115 and power outlet 1120, a doorbell 1125, a light fixture 1130, a control panel 1135, and an ethernet port 1140. In some embodiments, information received from the utilities (such as doorbell signals, light levels, ethernet data, and the like) can be provided back to the home automation box 1110, which can encode the information into data signals for transmission back through the single connector 1105 within the power signals.

By combining data and power signals within a single conduit, the prefabricated wall panel 1100 can include just the single connector 1105. This simplifies manufacturing of the prefabricated wall panel 1100, it simplifies assembly of a structure using the prefabricated wall panel (since connecting the wall panel to other wall panels requires coupling only the single connector 1105 and not multiple connectors), and it centralizes all data and power transmission within the structure. Accordingly, the use of a single connector 1105 can reduce the cost and difficulty of both manufacturing and assembling prefabricated wall panels or structures made of the prefabricated wall panels.

Figure 12:
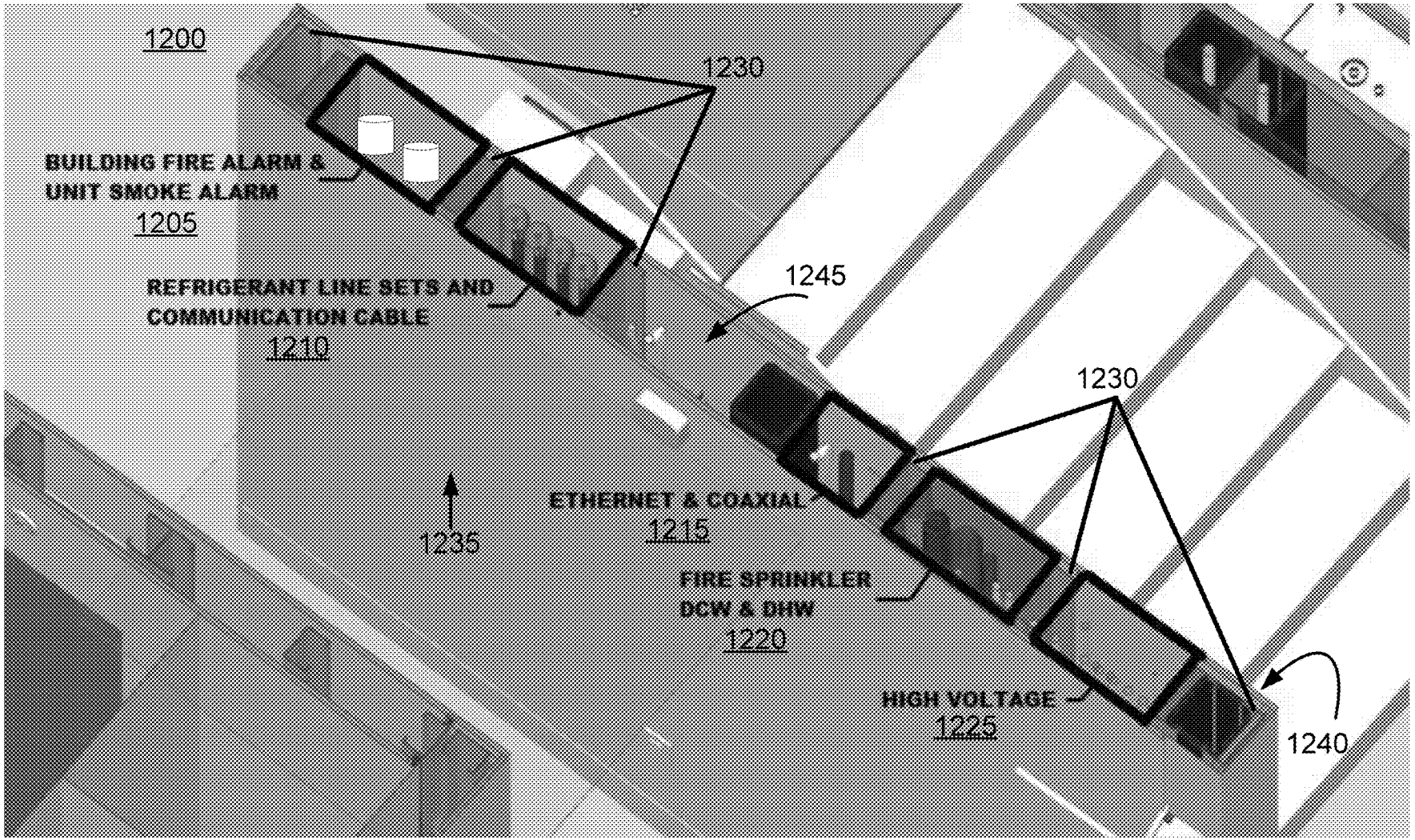
FIG. 12 illustrates a set of conduits pre-installed within a prefabricated riser wall panel, according to one embodiment.

FIG. 12 illustrates a set of conduits pre-installed within a prefabricated riser wall panel, according to one embodiment. The riser wall 1200 of the embodiment of FIG. 12 includes a front surface 1235 and a rear surface 1240 separated by a set of supports 1230. It should be noted that although a particular riser wall embodiment is shown in FIG. 12, in practice a riser wall 1200 can taken any suitable form or shape, can have any number of supports, and can include any number of conduits in any arrangement.

In the embodiment of FIG. 12, the riser wall 1200 includes spacings between the front surface 1235 and the rear surface 1240, between each pair of adjacent supports 1230. One such spacing is the spacing 1245. One or more sets of conduits can be pre-installed within the riser wall 1200, for instance at the point of manufacture of the riser wall, prior to the riser wall being transported to a construction site, or prior to the riser wall being installed. The one or more sets of conduits are routed within one or more of the spacings of the riser wall 1200 such that when the riser wall is installed, the one or more sets of conduits can be routed to other wall panels (e.g., with the same room, on the same floor, or on different floors), to ceiling panels, or to one or more devices, systems, outlets, appliances, or fixtures.

The riser wall 1200 includes building fire alarm and unit smoke alarm conduits 1205 within a first riser wall spacing, refrigerant line sets and communication cable conduits 1210 in a second riser wall spacing, ethernet and coaxial conduits 1215 in a third riser wall spacing, fire sprinkler and cold water ("DCW")/hot water ("DHW") conduits 1220 in a fourth riser wall spacing, and high voltage conduit 1225 in a fifth riser wall spacing. Although the conduits of the riser wall 1200 are illustrated as being routed vertically through the riser wall, in practice the conduits can be routed horizontally through the riser panel, in any direction through the riser panel, and in any combination of directions.

Although particular conduits are illustrated in the embodiment of FIG. 12, any conduits within a building unit can be routed through the riser wall 1200. For instance, embodiments of the riser wall 1200 can include electrical conduit (e.g., high voltage conduit); data, networking, telecommunications, ethernet, coaxial, or low voltage conduit; HVAC conduit, such as heating ducts, air conditioning ducts, or ventilation ducts; fire alarm, smoke alarm, carbon monoxide alarm, or toxic substance alarm conduit; humidity, particulate, temperature, carbon dioxide, or dust detection conduit; refrigerant conduit; hot water, cold water, and waste water conduit ("plumbing conduit" individually or collectively); fire sprinkler or fire suppressant conduit; natural gas or fuel conduit; or any other suitable conduit.

Each conduit within a set of conduits can be coupled to one or more systems, objects, devices, outlets, plugs, interfaces, appliances, or fixtures within a building unit or structure, both within the riser wall 1200 or within another wall, ceiling, or portion of the building unit or structure. For instance, electrical conduits (such as high voltage power conduit) can be coupled to electrical conduits in other walls or ceilings, and in turn to one or more outlets within those walls or ceilings, thereby providing electricity throughout the building unit or structure. In some embodiments, each prefabricated wall within a building unit or structure includes electrical conduit pre-installed within the wall panel, and each wall panel is electrically coupled either directly or via one or more additional wall panels to the riser wall such that electricity is provided from the electrical conduit of the riser wall into and through the electrical conduit within the additional wall panels.

In some embodiments, each wall panel includes an electrical conduit coupling to enable the efficient coupling of electrical conduit throughout a building unit or structure. For instance, each wall panel can include one or more electrical plugs and/or one or more electrical sockets to enable an installer to quickly plug a first wall panel plug into a second wall panel socket, thereby electrically coupling the first wall panel and the second wall panel. In some embodiments, each wall panel includes an electrical conduit couple within a threshold distance of an edge or a corner of the wall panel, thereby reducing or minimizing the amount of conduit required to electrically couple wall panels together.

In some embodiments, communications conduit (such as Ethernet cable, CAT cable, USB cable, low voltage cable, and the like) to be coupled to one or more digital devices, IoT devices, or communications outlets, allowing for the transmission of data via the communications conduit within the building unit or structure. In some embodiments, a fire alarm conduit can couple to a smoke detector, and a fire sprinkler conduit can couple to a fire sprinkler, thereby enabling smoke detected in a first room to cause the fire sprinkler to spray either within the first room and/or within one or more additional rooms within the building unit or structure. In some embodiments, HVAC conduit can couple to a vent, an air conditioning unit, a heater or furnace, or a fan. In some embodiments, plumbing conduit can couple to a sink, a drain, a toilet, a shower, a bathtub, a washer/dryer, a dishwasher, or to any other suitable appliance or object that requires water and/or the removal of waste water.

The arrangement of combination of conduits within the riser wall 1200 of the embodiment of FIG. 12 are exemplary, and in practice, conduits can be routed or combined within the riser wall 1200 in any suitable order or combination. For instance, in some embodiments, all conduits within a riser wall 1200 can be included within the same spacing within the riser wall. Such embodiments beneficially simply the connection of conduits to reciprocal conduits in other wall or ceiling panels. In some embodiments, certain types of conduits can be routed through the riser wall within the same conduit housing. For instance, cold water conduit and fire sprinkler conduit can include the same water pipes, or can include different water pipes coupled together within a same pipe housing.

The riser wall 1200, when installed within a building or other structure, can couple to a second panel (such as another wall panel or a ceiling panel) with reciprocal conduits such that the conduits from the riser wall can couple to the reciprocal conduits of the second panel. As noted herein, coupling conduit together can include physical couplings on a first wall panel and reciprocal physical couplings on a second wall panel (such as network cable plugs and sockets, male and female plumbing pipe fixtures, electrical plugs and sockets, and the like). Accordingly, the conduits routed through the riser wall 1200 prior to installation of the riser wall can be coupled to conduits throughout the building structure (such as conduits pre-installed without other wall panels or ceiling panels) without requiring the manual routing of these conduits throughout the building structure (and instead requiring only the coupling of the pre-installed conduits to each other in some instances).

The prefabricated panels described herein can include any number or combination of conduits, including the example conduits specifically described herein. However, for the sake of simplicity, reference is made in the description of various wall panel embodiments herein to a "set of conduits". It should be noted that this is not limiting, and that reference to a set of conduits can likewise include any number or combination of conduits.

Figure 13:
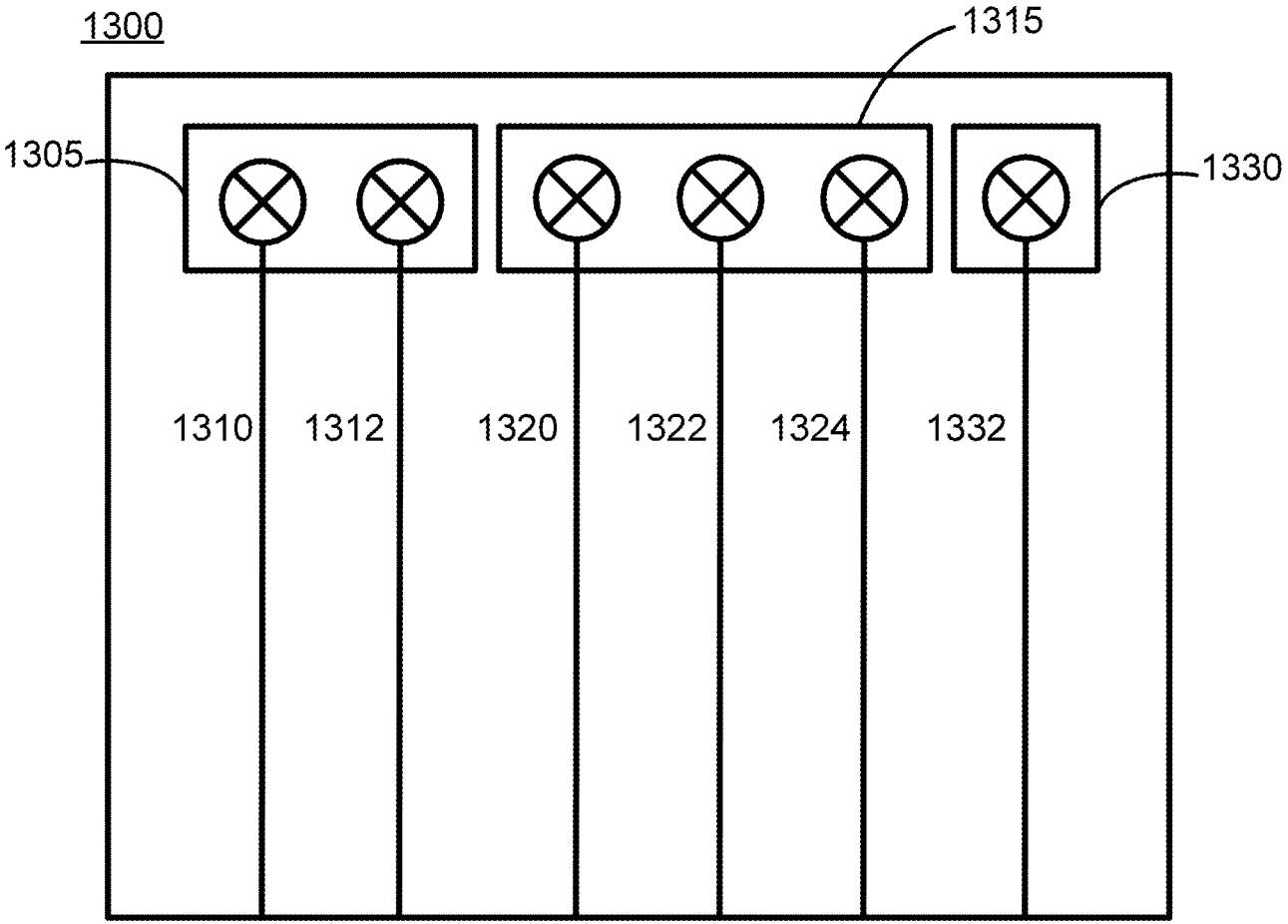
FIG. 13 illustrates a set of conduits pre-installed within a prefabricated riser wall panel and coupled to a set of conduit couplings within multiple housings, according to one embodiment.

FIG. 13 illustrates a set of conduits pre-installed within a prefabricated riser wall panel and coupled to a set of conduit couplings within multiple housings, according to one embodiment. In the embodiment of FIG. 13, a set of six conduits (conduits 1310, 1312, 1320, 1322, 1324, and 1332) are routed within the riser wall 1300. The riser wall 1300 includes three conduit couplings, couplings 1305, 1315, and 1330. In other embodiments, conduits can be coupled to conduit couplings in different arrangements than illustrated in FIG. 13.

In one example, the conduit 1310 is plumbing conduit and the conduit 1312 is fire sprinkler conduit. In this example, the conduit coupling 1305 includes plumbing fixtures enabling the plumbing conduit and fire sprinkler conduit to be coupled to reciprocal plumbing fixtures in another wall panel or ceiling panel. Likewise, in this example, the conduit 1320 is digital communications conduit, the conduit 1322 is fire alarm conduit, and the conduit 1324 is electrical conduit. Continuing with this example, the conduit coupling 1315 includes power and communication outlets enabling the digital communications conduit, fire alarm conduit, and electrical conduit to be coupled to reciprocal power and communication outlets in another wall panel or ceiling panel. Finally, in this example, the conduit 1332 is HVAC conduit, and the conduit coupling 1330 is a vent, enabling the HVAC conduit to couple to reciprocal ducting in another wall panel or ceiling panel.

In some embodiments, a first riser wall in a first floor can be located under another riser wall in a second floor above the first floor. In such embodiments, the conduit pre-installed within the first riser wall can be routed up and into the second riser wall, enabling conduit to be routed to multiple floors within a building unit or structure. The conduit can be routed from each riser wall to other walls, systems, outlets, devices, appliances, or fixtures within the corresponding floor.

Figure 14:
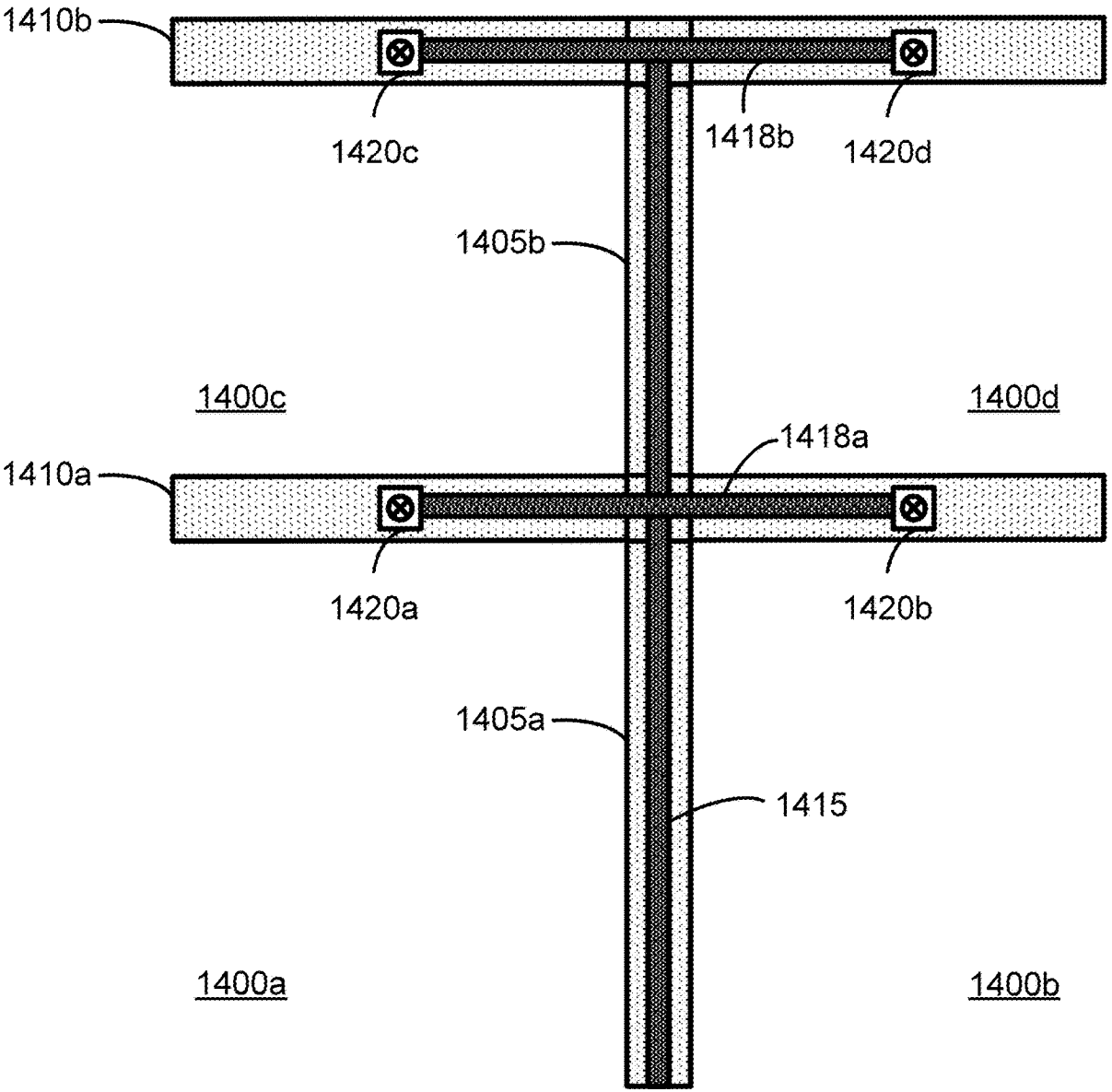
FIG. 14 illustrates prefabricated riser wall panel conduit routing within a multi-story building unit, according to one embodiment.

FIG. 14 illustrates prefabricated riser wall panel conduit routing within a multi-story building unit, according to one embodiment. In the embodiment of FIG. 14, a first riser wall 1405*a* abuts a room 1400*a* and a room 1400*b*, and a second riser wall 1405*b* above the first riser wall abuts a room 1400*c* and a room 1400*d*. A set of conduits 1415 is routed through the first riser wall 1405*a*, and into and through the second riser wall 1405*b*. For example, the first riser wall 1405*a* can include conduit couplings that couple to reciprocal conduit couplings of the second riser wall 1405*b*, enabling a first pre-installed set of conduits within the first riser wall to couple to a second pre-installed set of conduits within the second riser wall to form the set of conduits 1415.

The set of conduits 1415 can be coupled to a first set of conduits 1418*a* pre-installed within a first prefabricated ceiling panel 1410*a*. Likewise, the set of conduits 1415 can be coupled to a second set of conduits 1418*b* pre-installed within a second prefabricated ceiling panel 1410*b*. In the embodiment of FIG. 14, the first set of conduits is coupled to a first system 1420*a* located within the room 1400*a* and a second system 1420*b* within the room 1400*b*, and the second set of conduits is coupled to a third system 1420*c* within the room 1400*c* and a fourth system 1420*d* within the room 1400*d*. For instance, the systems 1420*a-d* can be smart light fixtures, smoke detector devices, communication outlets, smart speakers, IoT devices, vents, or any other suitable system, device, or the like. Accordingly, by aligning or nearly aligning riser walls between floors or a building or structure, sets of conduits can be routed between floors (e.g., vertical routing) without requiring significant routing within a floor/ceiling panel between the floors (e.g., horizontal routing).

In some embodiments, a floor of a building or structure can include one riser wall, while in other embodiments, a floor can include two or more riser walls. For instance, in some embodiments, if the floor of a structure is above a threshold size (e.g., above a threshold footprint, square footage, length, width, or the like), the floor of the structure can include one or more additional riser walls, each including a pre-installed set of conduits for routing within the floor. In some embodiments, if the floor of a structure or building includes multiple housing units, such as the floor of an apartment building or condo building), then each housing unit may include a separate riser wall. In some embodiments, adjacent housing units within a floor may share a riser wall such that the set of conduits pre-installed within the riser wall can be routed within each adjacent housing unit.

In order to assist with installation of prefabricated wall panels and ceiling panels within a structure, and with the coupling of conduits pre-installed within each wall panel and ceiling panel, prefabricated wall panels can include one or more cavities within the wall panel to enable the routing of conduits between the wall panel and one or more additional wall panels or ceiling panels. In certain embodiments, such cavities can be included above door frames within the prefabricated wall panels.

Figure 15:
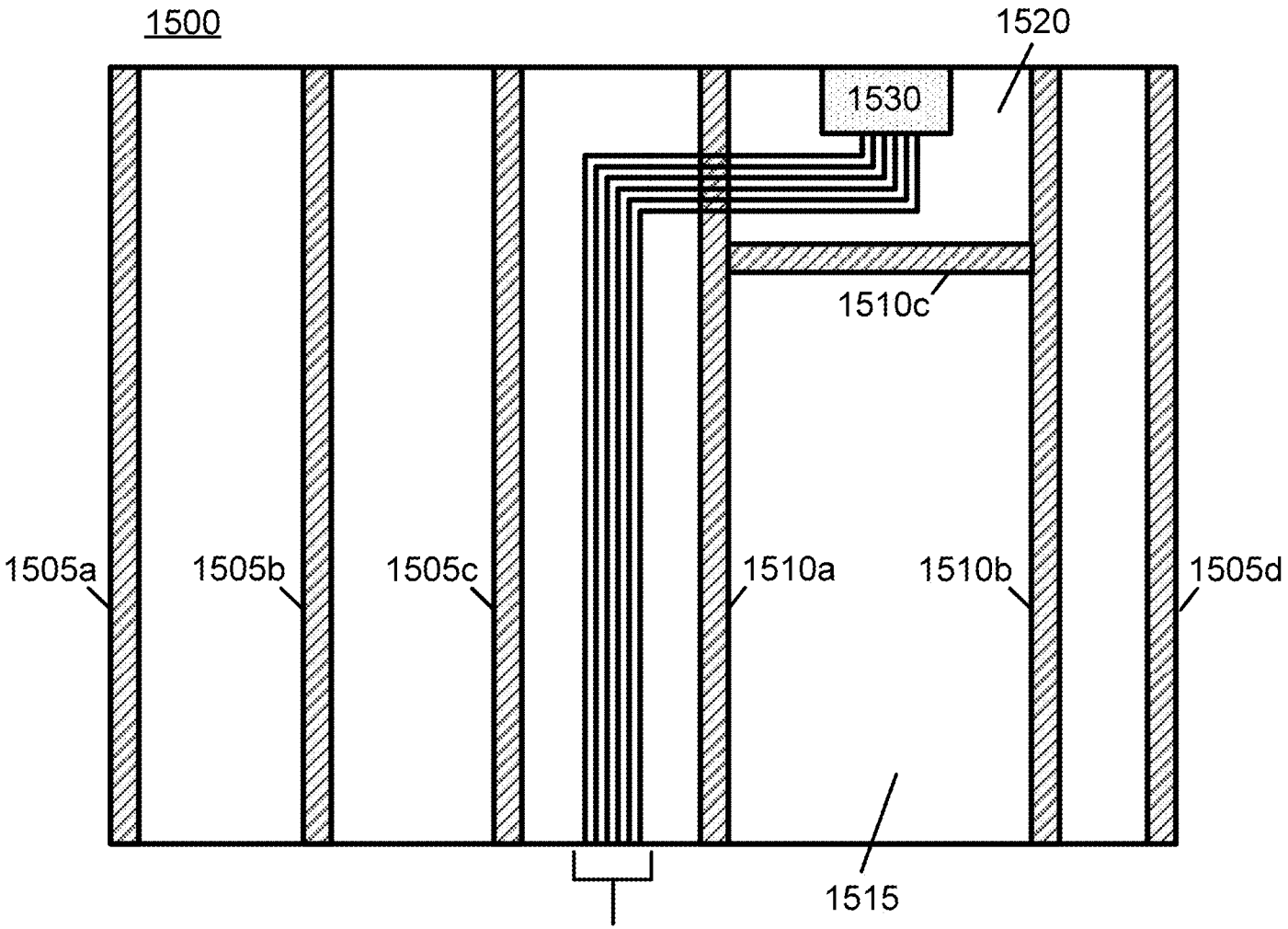
FIG. 15 illustrates an above-door conduit routing cavity within a prefabricated wall panel, according to one embodiment.

FIG. 15 illustrates an above-door conduit routing cavity within a prefabricated wall panel, according to one embodiment. In the embodiment of FIG. 15, a prefabricated wall panel 1500 includes a number of supports or studs (1505*a*, 1505*b*, 1505*c*, and 1505*d*) as well as a door frame 1515. The door frame 1515 includes a first side support or stud 1510*a*, a second side support or stud 1510*b*, and a top support or stud 1510*c*. Above the door frame 1515 is a cavity 1520 located between the first side support 1510*a* and the second side support 1510*b*, and above the top support 1510*c*. It should be noted that although one example of an above-door cavity 1520 is illustrated in the embodiment of FIG. 15, in practice the structure, dimension, location, or arrangement of components or the above-door cavity of the prefabricated wall panel 1500 can vary.

In the embodiment of FIG. 15, the wall panel 1500 is a riser wall, and includes a set of conduits 1525 that are vertically routed within the riser wall. The set of conduits 1525 are routed from a bottom edge or location within the wall panel 1500 and up between supports 1505*c* and 1510*a* and above the top support 1510*c*. From there, the set of conduits 1525 is routed horizontally into the above-door cavity 1520, and then vertically again to the conduit coupling 1530. The conduit coupling 1530 can enable the set of conduits 1525 to be, when the wall panel 1500 is coupled to a second prefabricated panel, to be coupled to a second set of conduits within the second prefabricated panel via a reciprocal conduit coupling that couples to the conduit coupling 1530.

Figure 16A:
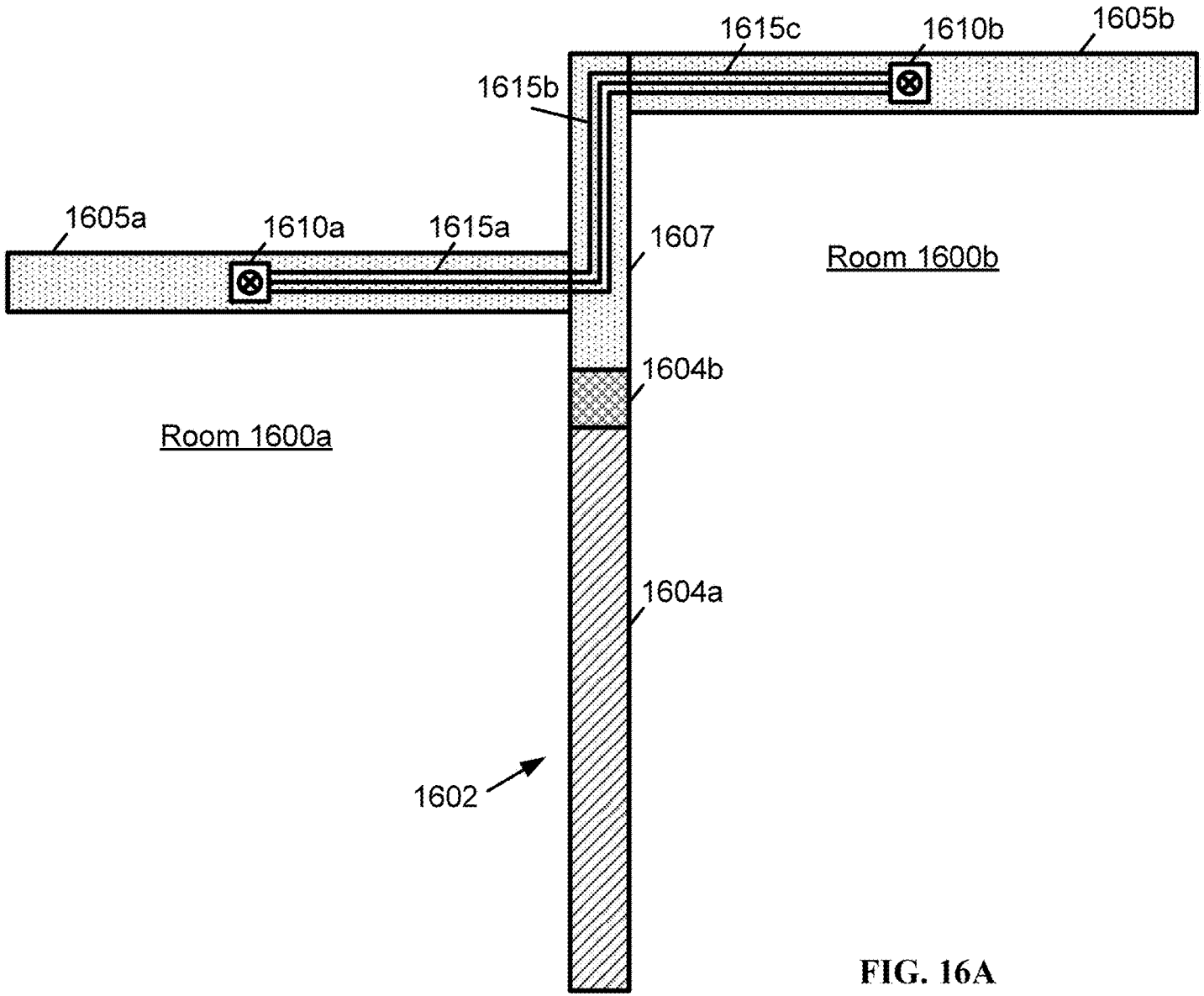
FIG. 16A illustrates conduit routed within a building unit with differing room ceiling heights via an above-door conduit routing cavity of a prefabricated wall panel, according to one embodiment.
Figure 16B:
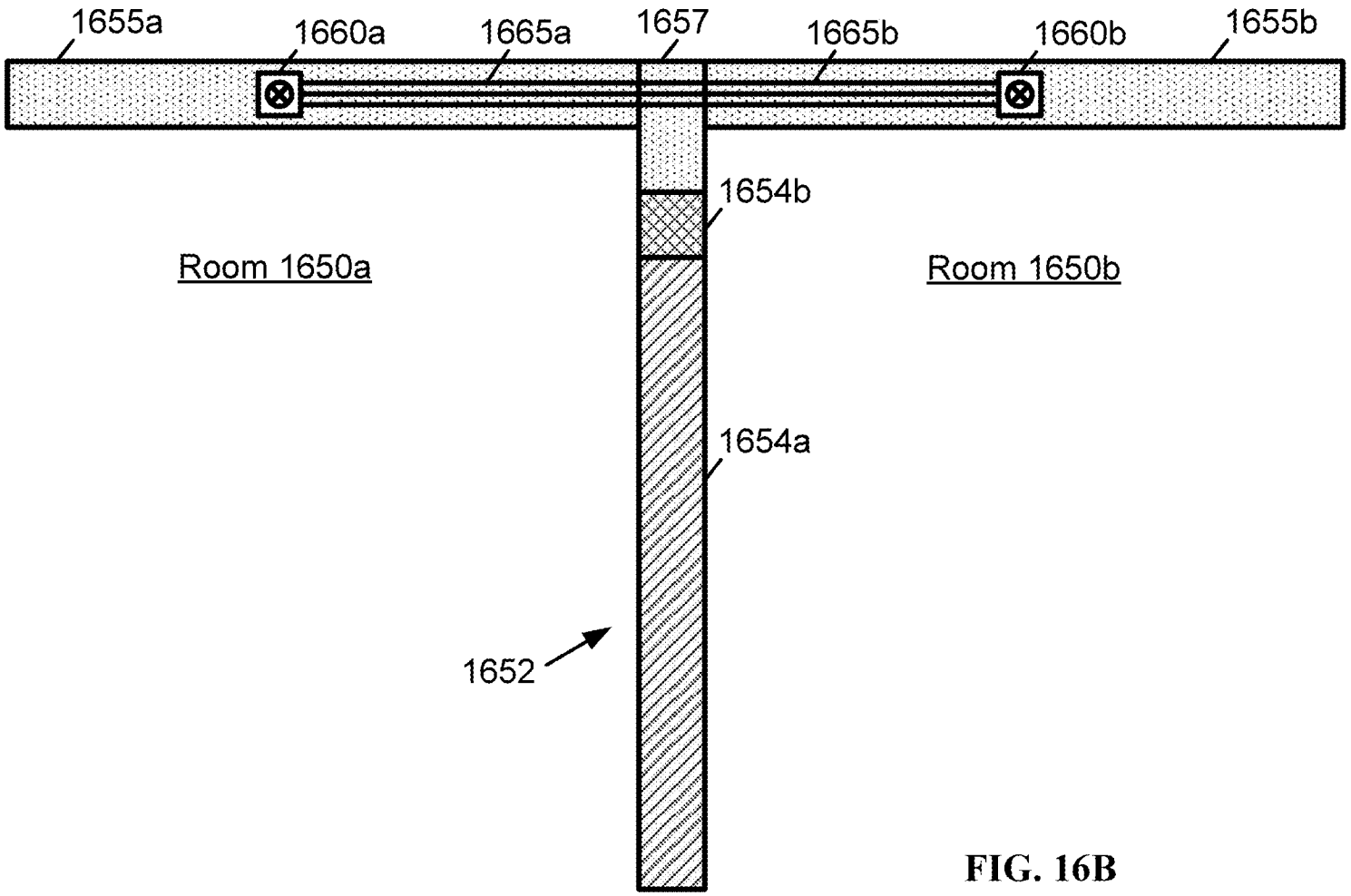
FIG. 16B illustrates conduit routed within a building unit with similar room ceiling heights via an above-door conduit routing cavity of a prefabricated wall panel, according to one embodiment.

The above-door cavity 1520 can be located in a prefabricated wall panel other than a riser wall, such as the wall panel illustrated in FIGS. 16A and 16B. FIG. 16A illustrates conduit routed within a building unit with differing room ceiling heights via an above-door conduit routing cavity of a prefabricated wall panel, according to one embodiment. In the embodiment of FIG. 16A, a prefabricated wall panel 1602 abuts each of room 1600*a* and room 1600*b*. As indicated in the embodiment of FIG. 16A, the heights for rooms 1600*a* and 1600*b* are different, though it should be noted that the configuration, heights, dimensions, or components associated with each room can vary without necessarily affecting the use of an above-door cavity in routing conduits between rooms or prefabricated panels.

The prefabricated wall panel 1602 includes a door frame 1604*a*, a top support 1604*b*, and an above-door cavity 1607 located above the top support. The room 1600*a* includes a prefabricated ceiling panel 1605*a*, which couples to the prefabricated wall panel 1602 at a height greater than the door frame. Likewise, the room 1600*b* includes a prefabricated ceiling panel 1605*b*, which couples to the prefabricated wall panel 1602 at a height greater than the door frame (and indeed, at a height greater than the ceiling panel 1605*a*).

A set of conduits 1615*a* preinstalled within the ceiling panel 1605*a* is coupled to a fixture 1610*a* (such as a light fixture). The set of conduits 1615*a* is routed from the ceiling panel 1605*a* and into the above-door cavity 1607, where the set of conduits 1615*a* are coupled to a set of conduits 1615*b* pre-installed within the wall panel 1602. The set of conduits 1615*b* are routed vertically through the above-door cavity 1607 and into the ceiling panel 1605*b*, where the set of conduits 1615*b* are coupled to a set of conduits 1615*c* pre-installed within the ceiling panel 1605*b*. The set of conduits 1615*c* is coupled to a fixture 1610*b*. Accordingly, a continuous set of conduits is routed between the fixture 1610*a* and the fixture 1610*b*, from the ceiling panel 1605*a* through the above-door cavity 1607 of the wall panel 1602 and into the ceiling panel 1605*b*, and is formed by the combined coupled sets of conduits 1615*a*, 1615*b*, and 1615*c*.

As illustrated in the embodiment of FIG. 16A, the set of conduits 1615*b* is routed within the above-door cavity 1607 or a distance equal to or greater than a difference between the ceiling heights of room 1600*a* and room 1600*b*. In practice, the set of conduits 1615*b* within the above-door cavity 1607 is substantially parallel to a side support of the door, or to a support or stud within the wall panel 1602. Further, in some embodiments, a set of conduits can be routed from a first above-door cavity of a prefabricated wall panel, through one or more additional ceiling panels or wall panels, and into a second above-door cavity of a second prefabricated wall panel, beneficially enabling conduit to be routed between any number of wall panels and ceiling panels, via any number of above-door cavities.

As noted above, the sets of conduits 1615*a*, 1615*b*, and 1615*c* can be coupled via one or more conduit couplings. For instance, the ceiling panel 1605*a* can include a conduit coupling within a threshold distance of the portion of the ceiling panel 1605*a* that abuts the wall panel 1602. Likewise, the wall panel 1602 can include a reciprocal conduit coupling that couples to the conduit coupling of the ceiling panel 1605*a*. The conduit couplings, when coupled, enabling the set of conduits 1610*a* to couple to the set of conduits 1605*b*. For example, the conduit couplings can include electrical connectors enabling an electrical conduit to couple to another electrical conduit, can include plumbing conduits enabling pipes to be coupled, or can include networking cable conduits enabling networking cables to be physically or communicatively coupled.

FIG. 16B illustrates conduit routed within a building unit with similar room ceiling heights via an above-door conduit routing cavity of a prefabricated wall panel, according to one embodiment. In the embodiment of FIG. 16B, a prefabricated wall panel 1652 abuts each of room 1650*a* and room 1650*b*. As indicated in the embodiment of FIG. 16B, the heights for rooms 1650*a* and 1650*b* are the same, though it should be noted that the configuration, heights, dimensions, or components associated with each room can vary without necessarily affecting the use of an above-door cavity in routing conduits between rooms or prefabricated panels.

The prefabricated wall panel 1652 includes a door frame 1654*a*, a top support 1654*b*, and an above-door cavity 1657 located above the top support. The room 1650*a* includes a prefabricated ceiling panel 1655*a*, which couples to the prefabricated wall panel 1652 at a height greater than the door frame. Likewise, the room 1650*b* includes a prefabricated ceiling panel 1655*b*, which couples to the prefabricated wall panel 1652 at a height greater than the door frame and equal to the height of the ceiling panel 1655*a*.

A set of conduits 1665*a* preinstalled within the ceiling panel 1665*a* is coupled to a fixture 1660*a* (such as a light fixture). The set of conduits 1665*a* is routed from the ceiling panel 1655*a* and into the above-door cavity 1657, where the set of conduits 1665*a* are coupled to a set of conduits 1665*b* pre-installed within the ceiling panel 1655*b* and routed into the above-door cavity. The set of conduits 1665*c* is coupled to a fixture 1660*b*. Accordingly, a continuous set of conduits is routed between the fixture 1660*a* and the fixture 1660*b*, from the ceiling panel 1655*a* through the above-door cavity

1657 of the wall panel 1652 and into the ceiling panel 1655*b*, and is formed by the combined coupled sets of conduits 1665*a* and 1665*b*.

By including above-door cavities for routing conduiting, when the prefabricated wall panels are installed within a building unit or structure, the people installing the prefabricated wall panels have predictable portions of the structure where conduit can be routed without obstacle. Likewise, designers of building units or structures that are creating designs using prefabricated wall panels are able to rely upon the above-door cavities for the purposes of routing conduit when creating their design. Further, above-door cavities can be leveraged to enable the routing of conduit between rooms of different heights. In such instances, without the presence of dedicated space for conduit routing within a wall panel, an installer has to manually route conduit through a portion of the wall panel that may not otherwise be configured for routing conduit within (or that may not otherwise have conduit pre-installed within).

It should be noted that although reference is made herein to above-door cavities, in practice, the principle of including cavities within prefabricated wall panels for the purposes of reserving space within a prefabricated wall panel for routing cable between wall panels and/or ceiling panels is not limited to areas above doors. For instance, prefabricated wall panels can include cavities above or below windows within the prefabricated wall panels, above or below vents, above or below outlets, or at any location within the prefabricated wall panel (e.g., within a reserved space between wall panels supports, at pre-determined distances from a side, top, or bottom of a prefabricated wall panel, at a manufacturer- or designer-selected location, or at any suitable location with the prefabricated wall panel).

Figure 17:
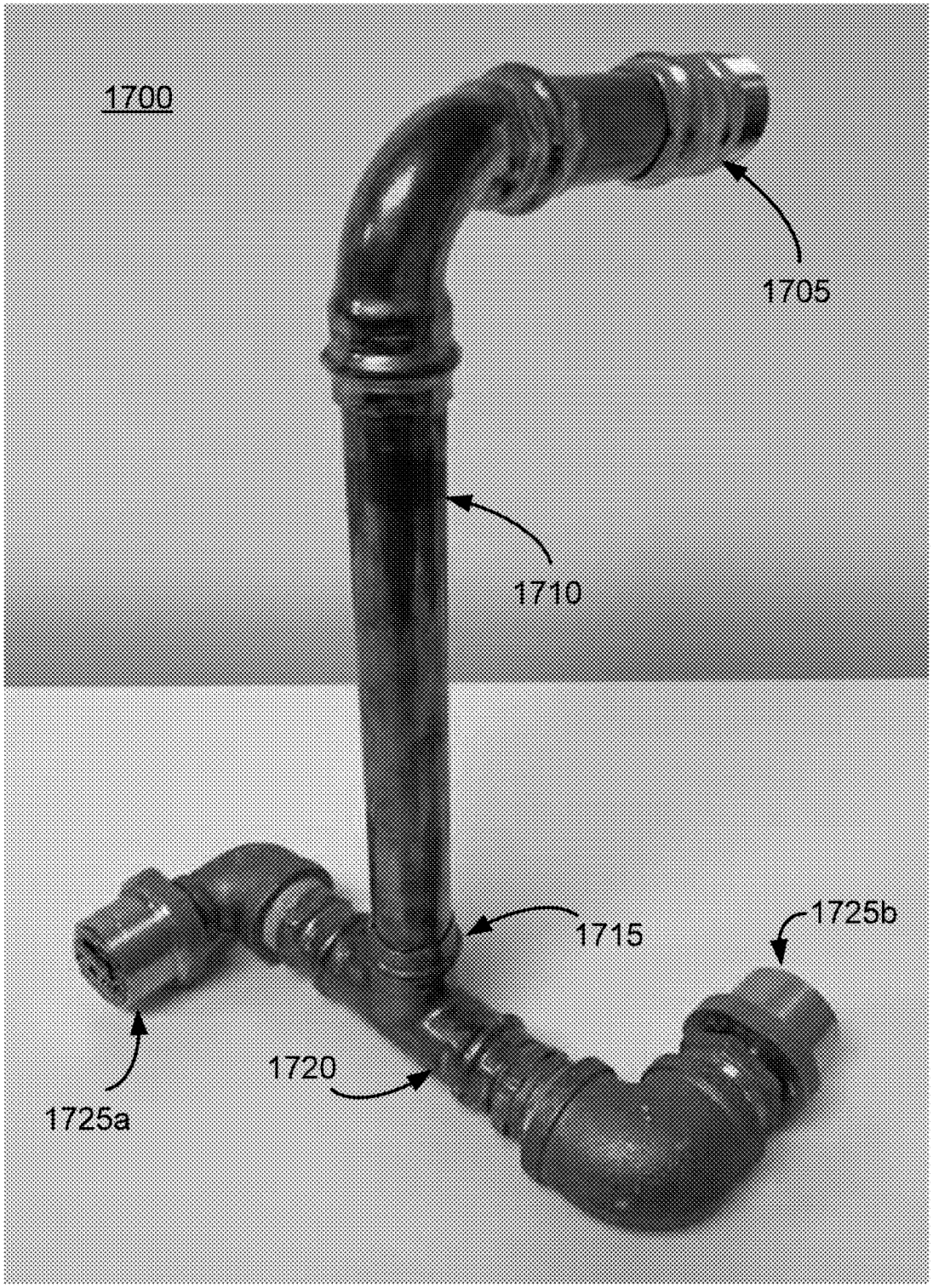
FIG. 17 illustrates a multi-head fire sprinkler mechanism for pre-installation in a prefabricated wall panel, according to one embodiment.

FIG. 17 illustrates a multi-head fire sprinkler mechanism for pre-installation in a prefabricated wall panel, according to one embodiment. In the embodiment of FIG. 17, a fire sprinkler mechanism 1700 can include a first pipe component 1705, a second pipe component 1710, a third pipe component 1720, and sprinkler heads 1725*a* and 1725*b*. In practice, various other embodiments of a multi-head fire sprinkler mechanism can include fewer, additional, or different components than those illustrated herein.

The first pipe component is coupled to the second pipe component 1710 via a right-angle coupling. The first pipe component 1705 is perpendicular to the second pipe component 1710. In some embodiments, the first pipe component1 1705 is a component of the fire sprinkler mechanism 1700, and the entire fire sprinkler mechanism is installed with a prefabricated wall panel. In other embodiments, the first pipe component1 1705 is routed within a different prefabricated wall panel, such as a ceiling panel, and the second pipe component 1710 extends downward into a prefabricated wall panel coupled to the ceiling panel.

The second pipe component 1710 is coupled to the third pipe component 1720 via a "T" coupling. The third pipe component 1720 is perpendicular to the second pipe component 1710. In some embodiments, the entirety of the third pipe component 1720 is embedded within a prefabricated wall panel, while in other embodiments, the third pipe component extends through surfaces of the prefabricated wall panel and into rooms abutting the prefabricated wall panel. In the embodiment of FIG. 17, a first sprinkler head 1725*a* is coupled to the third pipe component 1720 via a first right angle joint, and a second sprinkler head 1725*b* is coupled to the third pipe component via a second right angle joint. In practice, the first sprinkler heads 1725 can be coupled directly to the third pipe component 1720 (e.g., without the right angle joints).

The multi-head fire sprinkler mechanisms described herein can reduce the overall number of fire sprinkler mechanisms required to provide sprinkler coverage in every room of a building unit or structure, since each can spray into up to two different rooms. Accordingly, in some embodiments, the number of fire sprinkler mechanisms required for a structure, building unit, or floor is less than the number of rooms within the structure, building unit, or floor. In some embodiments, the number of fire sprinkler mechanisms required is equal to half the number of rooms within the structure, building unit, or floor. In some embodiments, the number of fire sprinkler mechanisms required is a number greater than half the number of rooms, but less than the number of rooms within the structure, building unit, or floor.

Figure 18:
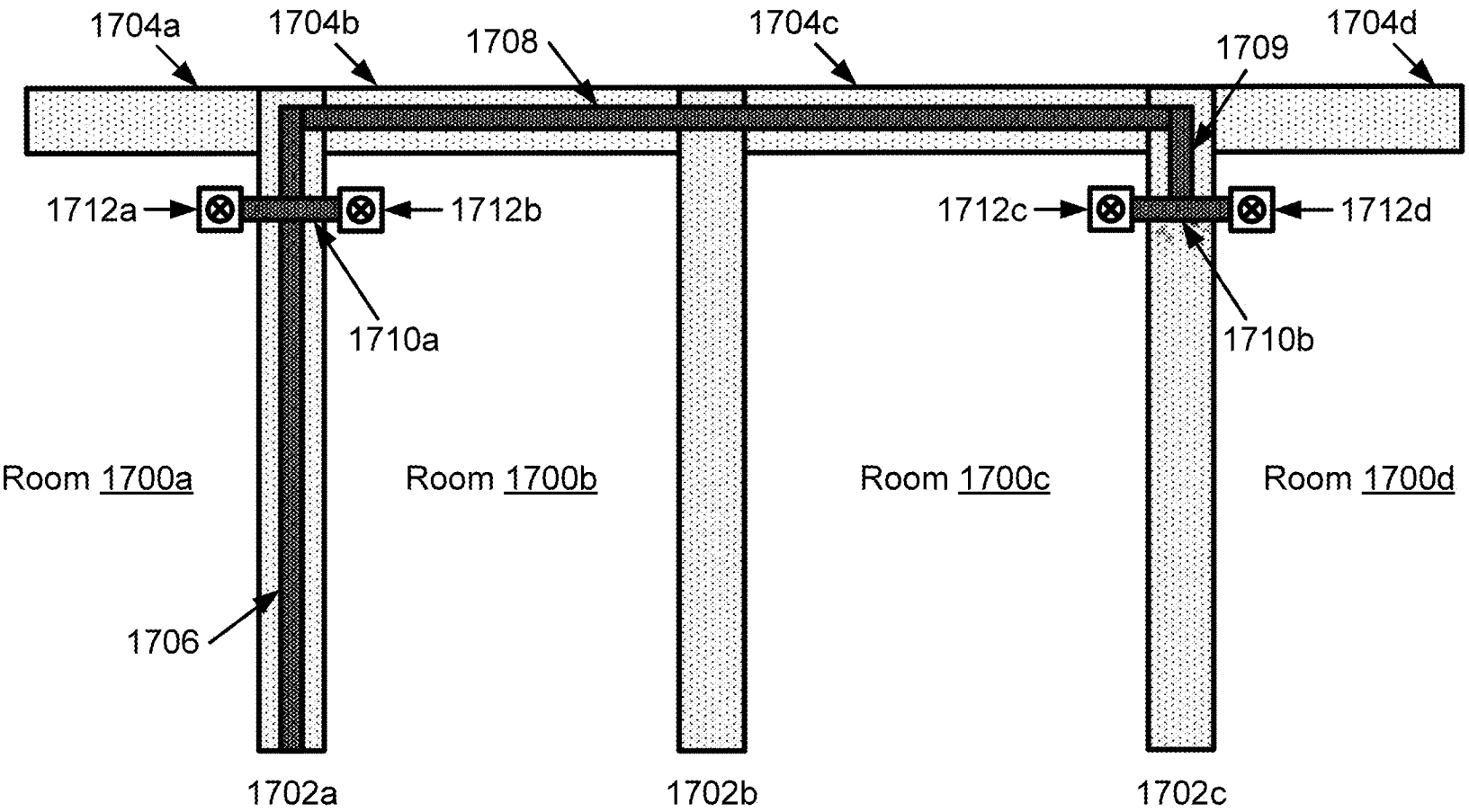
FIG. 18 illustrates a multi-room building unit with prefabricated wall panels including multi-head fire sprinklers, according to one embodiment.

FIG. 18 illustrates a multi-room building unit with prefabricated wall panels including multi-head fire sprinklers, according to one embodiment. In the embodiment of FIG. 18, the building unit includes four rooms: room 1700*a*, room 1700*b*, room 1700*c*, and room 1700*d*. A first prefabricated wall panel 1702*a* abuts the room 1700*a* and the room 1700*b*, a second prefabricated wall panel 1702*b* abuts the room 1700*b* and the room 1700*c*, and a third prefabricated wall panel 1702*c* abuts the room 1700*c* and the room 1700*d*. It should be noted that the multi-head fire sprinklers described herein can be implemented in buildings unit of different structures, configurations, and numbers of rooms.

A first prefabricated ceiling panel 1704*a* is coupled to the first prefabricated wall panel 1702*a*. A second prefabricated ceiling panel 1704*b* is coupled to the first prefabricated wall panel 1702*a* and the second prefabricated wall panel 1702*b*. A third prefabricated ceiling panel 1704*c* is coupled to the second prefabricated wall panel 1702*b* and the third prefabricated wall panel 1702*c*. A fourth prefabricated ceiling panel 1704*d* is coupled to the third prefabricated wall panel 1702*c*.

A fire sprinkler conduit 1706 is pre-installed within the first prefabricated wall panel 1702*a*, and is routed vertically through the first prefabricated wall panel 1702*a*. The first sprinkler conduit 1706 is coupled to a second fire sprinkler conduit 1708 that is pre-installed and routed horizontally within the ceiling panels 1704*b* and 1704*c*. The second fire sprinkler conduit 1708 is coupled to a third fire sprinkler conduit 1709 that is pre-installed and route vertically within the third prefabricated wall panel 1702*c*. Accordingly, the fire sprinkler conduits 1706, 1708, and 1709 form a collective fire sprinkler conduit that is routed through two prefabricated wall panels (1702*a* and 1702*c*) that collectively abut each of the four rooms 1700*a*, 1700*b*, 1700*c*, and 1700*d*.

A first multi-head fire sprinkler mechanism 1710*a* is coupled to the fire sprinkler conduit 1706 and a second multi-head fire sprinkler mechanism 1710*b* is coupled to the fire sprinkler 1709. The first multi-head fire sprinkler mechanism 1710*a* extends through the prefabricated wall panel 1702*a* and into the room 1700*a* and the room 1700*b*. A first sprinkler 1712*a* is coupled to a first side of the first multi-head fire sprinkler mechanism 1710*a* within the room 1700*a*, and a second sprinkler 1712*b* is coupled to a second side of the first multi-head fire sprinkler mechanism 1710*a* within the room 1700*b*. A third sprinkler 1712*c* is coupled to a first side of the second multi-head fire sprinkler mechanism 1710*b* within the room 1700*c*, and a fourth sprinkler 1712*d* is coupled to a second side of the second multi-head fire sprinkler mechanism 1710*b* within the room 1700*d*.

In the embodiment of FIG. 18, just two multi-head fire sprinkler mechanisms are included within the building unit, yet each of the four rooms 1700*a*, 1700*b*, 1700*c*, and 1700*d* include a fire sprinkler (1712*a*, 1712*b*, 1712*c*, and 1712*d* respectively). In some embodiments, so long as a spray range of a fire sprinkler covers more than a threshold percentage of or a threshold distance of a room, only one wall panel abutting the room may have a fire sprinkler. In such embodiments, when a spray range of a fire sprinkler covers less than a threshold percentage of or a threshold distance of the room, multiple wall panels abutting the room may have a fire sprinkler (e.g., opposite wall panels). As used herein, "spray range" refers to a portion of a room that a fire sprinkler can spray water or fire suppressant on when the fire sprinkler is activated. In some embodiments, sprinklers of the multi-head fire sprinkler mechanisms protrude from a wall panel within a threshold distance of a top of the wall panel.

CONCLUSION

The above description is included to illustrate the operation of the embodiments and is not meant to limit the scope of the invention. The scope of the invention is to be limited only by the following claims. From the above discussion, many variations will be apparent to one skilled in the relevant art that would yet be encompassed by the spirit and scope of the invention. As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

What is claimed is:

1. A modular building unit comprising:

a plurality of prefabricated panels comprising wall panels and ceiling panels coupled to form a first room in a first story of the modular building unit and a second room at least partially above the first room in a second story of the modular building unit, wherein a first wall panel comprises:

a first surface and a second surface, a first set of conduits embedded within the first wall panel of the wall panels, the first set of conduits comprising first HVAC conduit, first electrical conduit, first plumbing conduit, first fire alarm conduit, first fire sprinkler conduit, and first digital communications conduit, a plurality of first supports separating the first surface from the second surface and separating at least one conduit from another conduit in the first set of conduits, a first conduit coupling embedded within the first wall panel within a threshold distance of a top of the first wall panel, wherein the first conduit coupling is configured to reciprocally couple to a second conduit coupling embedded within a ceiling panel such that the first set of conduits extends into the ceiling panel via the first conduit coupling and the second conduit coupling;

wherein a second wall panel comprises:

a third surface and a fourth surface, a second set of conduits embedded within the second wall panel of the wall panels, the second set of conduits comprising second HVAC conduit, second electrical conduit, second plumbing conduit, second fire alarm conduit, second fire sprinkler conduit, and second digital communications conduit, a plurality of second supports separating the third surface from the fourth surface and separating at least one conduit from another conduit in the second set of conduits;

wherein the second wall panel is configured to be coupled immediately or within the threshold distance above the first wall panel, and, the first set of conduits at a top of the first wall panel is configured to be coupled to the second set of conduits at a bottom of the second wall panel such that the first HVAC conduit is configured to be coupled to the second HVAC conduit, the first electrical conduit is configured to be coupled to the second electrical conduit, the first plumbing conduit is configured to be coupled to the second plumbing conduit, the first fire alarm conduit is configured to be coupled to the second fire alarm conduit, the first fire sprinkler conduit is configured to be coupled to the second fire sprinkler conduit, and the first digital communications conduit is configured to be coupled to the second digital communications conduit;

a set of electrical couplings embedded within each of the wall panels forming the first room enabling each wall panel forming the first room to be electrically coupled to the first or second set of conduits of the first or second wall panels directly or through one or more adjacent wall panels;

a set of digital devices embedded within one or more of the prefabricated panels forming the first room each communicatively coupled to the first or second set of conduits of the first or second wall panels;

a fire sprinkler embedded within at least one of the prefabricated panels forming the first room and coupled to the first or second set of conduits of the first or second wall panels; and a fire alarm embedded within at least one of the prefabricated panels forming the first room and coupled to the first or second set of conduits of the first or second wall panels.

2. The modular building unit of claim 1, wherein each wall panel forming the first room includes at least one electrical coupling of the set of electrical couplings and an embedded electrical conduit electrically coupled to at least one electrical coupling such that embedded electrical conduit is electrically coupled to the electrical conduit of the first wall panel via the at least one electrical coupling.

3. The modular building unit of claim 2, wherein the embedded electrical conduit within a wall panel further electrically couples to a power outlet within the wall panel.

4. The modular building unit of claim 1, wherein each electric coupling is within a threshold distance of an edge of a wall panel.

5. The modular building unit of claim 1, wherein each electric coupling is within a threshold distance of a corner of a wall panel.

6. The modular building unit of claim 1, wherein the first set of conduits runs vertically within the first wall panel.

7. The modular building unit of claim 1, wherein the set of digital devices includes one or more of: a computing system, a thermostat, an IOT device, a light switch, a low voltage device, and a digital wall port.

8. The modular building unit of claim 1, wherein the first digital communications conduit comprises one or more of network cable and a low voltage line.

9. The modular building unit of claim 1, wherein at least one of the prefabricated panels includes one or more of a vent, an air outlet, an air conditioning unit, and a fan coil unit coupled to the first HVAC conduit, and wherein the first HVAC conduit comprises one or more of: a heated air duct, a cooled air duct, a ventilation duct, a heated refrigerant line, a cooled refrigerant line, and a condensation line.

10. The modular building unit of claim 1, wherein at least one wall panel includes embedded plumbing conduit and a plumbing fixture coupled to the first plumbing conduit of the first wall panel via the embedded plumbing conduit.

11. The modular building unit of claim 1, wherein the first plumbing conduit includes one or more of a hot water pipe, a cold water pipe, and a waste water pipe.

12. The modular building unit of claim 1, wherein the first fire sprinkler conduit enables a flow of water or a fire suppressant.

* * * * *